US009636571B1

(12) United States Patent
Curtis

(10) Patent No.: US 9,636,571 B1
(45) Date of Patent: May 2, 2017

(54) CASINO CRAPS SIDE BETS

(71) Applicant: James M. Curtis, Dade City, FL (US)

(72) Inventor: James M. Curtis, Dade City, FL (US)

( * ) Notice: Subject to any disclaimer, the term of this patent is extended or adjusted under 35 U.S.C. 154(b) by 263 days.

(21) Appl. No.: 14/337,156

(22) Filed: Jul. 21, 2014

Related U.S. Application Data

(60) Provisional application No. 61/856,694, filed on Jul. 20, 2013.

(51) Int. Cl.
*A63F 9/04* (2006.01)
*A63F 3/00* (2006.01)

(52) U.S. Cl.
CPC *A63F 3/00157* (2013.01); *A63F 2003/00164* (2013.01)

(58) Field of Classification Search
None
See application file for complete search history.

(56) References Cited

U.S. PATENT DOCUMENTS 6,601,848 B1 * 8/2003 Timmons, Sr. ..... A63F 9/04 273/146
6,755,420 B2 * 6/2004 Colton ..... A63F 3/00031 273/146
7,686,305 B2 * 3/2010 Stasi ..... A63F 3/00157 273/274
7,857,310 B2 * 12/2010 Yoshizawa ..... G07F 17/32 273/146
8,613,449 B2 * 12/2013 Brodrick ..... A63F 3/00157 273/274
2008/0061505 A1 * 3/2008 Snow ..... A63F 3/00157 273/274
2012/0034970 A1 * 2/2012 Stephens ..... A63F 3/00157 463/22
2015/0072761 A1 * 3/2015 Laduca ..... G07F 17/326 463/22

* cited by examiner

*Primary Examiner* — Sunit Pandya

(57) ABSTRACT

A method and apparatus for implementing a Casino Craps game with additional side bets. The "Point-STAY", "Seven-STAY", "SOSI" (Seven-Out-any-Seven-wIn) and "SOX" (Seven-Out-eXact-seven-win) bets are multiple stage bets, initiated after the point is established. First stage: the Point-STAY bet wins on the point, or loses on a seven-out; and the Seven-STAY bet wins on a seven-out, or loses on the point. Second stage: both bets win on a new point matching the previous point or lose on a new point differing from the previous point. First stage: the SOSI and the SOX bets win on a seven-out, or lose on the point. Additional stages: the SOSI wins on each additional seven, maximum of four wins, or loses on a point being established; and the SOX bet wins on each additional seven with the two dice combination matching the previous seven-out combination, maximum of two wins, or loses on a point being established.

8 Claims, 10 Drawing Sheets

CASINO CRAPS SIDE BETS

CROSS REFERENCE TO RELATED APPLICATIONS

This application claims benefit to U.S. provisional application 61/856,694, filed on Jul. 20, 2013 which is incorporated by reference herein in its entirety for all purposes.

BACKGROUND OF THE INVENTION

1. Field of the Invention

The present invention is directed to a method, apparatus, and computer readable storage medium for implementing a casino craps game with a plurality of side bets.

2. Description of Related Art

Casino craps is an exciting dice game which is well known and considered by many as the most popular dice game is the United States, both in the electronic gaming industry as well as in casinos.

The standard rules of play for casino craps are very well established, so there is no need to inform those having an ordinary skill in the art as to how casino craps is played. However, to understand the advantages of the present invention that is a modification to casino craps, a basic description of the game of casino craps is described herein. Casino craps involves two identical standard six-sided dice being rolled either across the playing surface of a gaming table of a casino or on the screen of an electronic gaming device ("EGD"), multiple times by a designated player (the "shooter"), to produce outcomes numbers used to determine the resolution of wagers placed on various bets by any of the players participating in the game. A bet can be resolved ("settled") as a winning bet, a losing bet or a tie ("push").

Each standard six-sided dice has a specific number of dots ("pips") as a visual representation of the numbers one to six, located on each of the six sides of the dice. Once a roll is completed the total number of pips showing on the upper most side of each dice is added together and the resulting numerical value is considered the "rolled outcome number". Of the thirty six possible combinations using two six-sided dice, there are eleven possible different outcome numbers, integers from 2 to 12 inclusive, as shown in Table 1.

TABLE 1

| Possible outcomes from adding the two dice values | | | | | | |
|---|---|---|---|---|---|---|
| | Die #1 | | | | | |
| Die #2 | 1 | 2 | 3 | 4 | 5 | 6 |
| 1 | 2 | 3 | 4 | 5 | 6 | 7 |
| 2 | 3 | 4 | 5 | 6 | 7 | 8 |
| 3 | 4 | 5 | 6 | 7 | 8 | 9 |
| 4 | 5 | 6 | 7 | 8 | 9 | 10 |
| 5 | 6 | 7 | 8 | 9 | 10 | 11 |
| 6 | 7 | 8 | 9 | 10 | 11 | 12 |

A game of casino craps consists of an unlimited number of "rounds", with the start of each new round in a multiple player game involving a different player, the next player in sequential order, being offered the opportunity to become the shooter. Each round consists of one or more of each of the two specific, separate and different phases. The initial phase of a round is called the "come-out phase", and the final phase of a round is called the "point phase". Dependent upon the outcome numbers rolled, a round will always include a minimum of two phases, one initial come-out phase and one final point phase. Dependent upon the outcome numbers rolled, a round can also include an undetermined number of additional phases in groups consisting of an additional point phase and an additional come-out phase called a "series" of phases. Each additional series included in a round are played after the initial come-out phase and prior to the final point phase.

A round including the minimum of two phases starts in the initial come-out phase. It moves from the initial come-out phase to a point phase upon a roll of an outcome number that is one of any of the numbers 4, 5, 6, 8, 9 or 10 ("place numbers"), and that number is then considered the "point number" during the following point phase. Rolling one of the place numbers ("establishing the point number") is the main objective of the come-out phase. A round then ends in the final point phase and can move from the final point phase to the start of a new round, upon completion of the current round, with a roll of an outcome number of 7 called a "seven-out".

For a round to be played for longer than the minimum two phases, it requires rolled outcome numbers during one or more point phase that allows for additional series of phases. To include a series of phases in a round, the point number must be rolled during a point phase ("making the point number" or being considered the "made point number") so a round can move to the start of an additional come-out phase, as part of a series of phases in that same round. Making the point number is the main objective of a point phase. During a series of phases, the main objective of the come-out phase is again to establish a point number for use during the following point phase. An unlimited number of additional series can be included during a round when a point number is made during each point phase, but the round ends upon the roll of a seven-out during a point phase.

Wagers can be placed on a variety of bets which include: (a) single roll bets; which are resolved with the next roll of the dice during either the come-out phase or the point phase, (b) multiple roll bets; which can take more than one roll of the dice to be resolved being initiated and resolved during the same phase, either the come-out phase or the point phase, (c) multiple roll bets; which can take more than one roll of the dice to be resolved being initiated in the come-out phase and being resolved during the point phase.

Each different bet follows specific bet guidelines regarding when the wager can be accepted for a bet ("initiated"); and while it is located on a physical gaming table or a simulated gaming table of a EGD ("in play"), when it is able to be resolved by a rolled outcome number ("active") or when it is not able to be resolved ("unresolved") by a rolled outcome number ("not active" or "non-active"). An active bet can automatically become not active when the round moves from one phase to another, or an active bet can be requested to become not active ("turned off") by a player. Similarly, a non-active can automatically become active when the round moves from one phase to another, or a non-active bet can be requested to become active ("turned on") by a player. Also, a bet can have an additional wager amount added by a player to an existing wager ("increased"), a bet can have a portion of the existing wager taken back by a player ("decreased") or a bet can have the entire amount of the existing wager taken back by a player ("removed"). See Tables 4a, 4b and 4c "Bet Guidelines", for a list of the specific bet guidelines for the prior art standard bets of casino craps, prior art side bets of casino craps, as well as the bets of the present invention.

Each different bet also follows specific rules regarding when it is a winning bet, a losing bet, a push or unresolved. See Tables 3a, 3b, and 3c "Payout Schedule", for a list of the specific rules of resolution for the different bets of the present invention. Recommended payout ratios for the different bets are also listed, but only as a guideline and are not intended to be defining or limiting.

In a game of prior art casino craps, when a round ends with a roll outcome number of a seven during a point phase, considered a seven-out, a current shooter's turn ends also. The new round that follows begins with an initial come-out phase with a new player becoming the shooter. All active bets are completed and removed from play when a roll outcome number is a seven-out. Put another way, there are no prior art casino craps bets that remain active being initialized in a first round and "carry forward" into another round, to be resolved in the later round.

In the game of prior art casino craps, bets that relate to the point number are resolved when the point number is made, not when the point number is established. There are a variety of prior art casino craps side bets which also relate to the point number. The side bets methods require that a bet is initiated prior to a point number being established and cannot be initialized or increased during a point phase of a round. They are then resolved when a point number is made, and require a quantity of point numbers to be made, whether it is unique point numbers or total point numbers. They also are not resolved when a point number is established.

U.S. Pat. No. 5,487,547 to Hobert describes a craps layout arrangement having jackpot area with the game of craps to be played in a conventional manner while simultaneously introducing a jackpot into the game. Specifically, a wager that a set of a plurality of dice outcomes are rolled, said set having a remote probability of occurrence. There are seven types of events which a host of the game could designate as the series to be completed. Six of the seven types discuss the method of completion being before a seven is rolled with the seventh type having to take place entirely during the come-out phase.

U.S. Pat. No. 6,655,689 to Staci describes a craps game improvement with a proposition bet for craps referred to as a FIRE BET™. The method includes predetermining a schedule of a pay-out table, players placing FIRE BET™ wagers at respective player betting areas prior to a shooter's initial come out; accumulating points responsive to outcomes of the shooter's dice throws, wherein point are made when a number 4, 5, 6, 8, 9 or 10 is twice rolled before sevening out, and wherein repeating of any made number is ignored, and making a pay-out based upon the points accumulated and the schedule.

Published U.S. patent application Ser. No. 11/591,362 to Snow describes a method of providing a running side bet wager on craps with a side bet added to the play of a game of Craps. A player places a side bet wager on an occurrence of at least two consecutive Pass events, and establishing a third Point without rolling a seven. After the third Point is made, a payout is awarded. All subsequent rolls gain a payout until the shooter rolls a seven.

Published U.S. patent application Ser. No. 11/835,358 to O'Conner describes bonus craps gaming with a bonus bet where a bonus outcome occurs when the sequence of dice roll outcomes includes a predetermined number of consecutive pass outcomes before a bonus bet termination event, such as a seven out or a crap out.

Though there are side bets for the game of casino craps that exist in the prior art, none of the above references disclose a method having a non-standard method of play, wherein a bet stays active and in play after a round ending seven-out, being resolved in the following round. In the standard method of a casino craps game, as well as prior art side bets, all active bets are removed from play upon a round ending seven-out. Further, none of the above references disclose a method having a non-standard method of play, wherein a bet is resolved by establishing a particular point number. In the standard method of a casino craps game, as well as prior art side bets, all bets relating to point numbers are resolved by making a particular point number.

What is needed is new casino craps side bet wager opportunities which can increase the game facilitator (casino, EGD administrator or other entity offering a game) profitability, as well as stimulate player involvement and enjoyment, by offering bets having non-standard methods of play.

SUMMARY OF THE INVENTION

It is an aspect of the present invention to provide exciting side bet opportunities in casino craps games, which stimulates additional player involvement, player enjoyment as well as increase game facilitator profitability.

The above aspects can be obtained by a method that includes: (a) providing an image of two identical standard six-sided dice; (b) providing an image of a gaming table; (c) providing wager box areas on the image of the gaming table for standard craps bets and bets of the present invention; (d) conducting a casino craps game; (e) offering to a player the opportunity to roll the dice; (f) considering a player to be the shooter when he or she rolls the dice; (g) allowing the simulation of a roll of the dice one or more times during a come-out phase until a point number is established; (h) receiving a wager from a player for at least one bet of a first set of bets; (i) allowing the simulation of a roll of the dice during a point phase to produce a roll outcome number; (j) determining if the roll outcome number is at least one of a predetermined first group of numbers, and if not, offering a player the option to increase a wager on any existing bet received in operation (h), or initiate a wager for an additional bet of a set of bets (if not previously initiated) and performing operation (i); (k) determining if a bet is at least one of a predetermined second set of bets, and if so, performing operation (q); (l) determining if the roll outcome number is the point number, and if so, performing operation (p); (m) considering the made point number to be the stay number; (n) considering a bet to be unresolved per a predetermined payout schedule for a winning outcome as defined by the rules of resolution and the bet remaining active and in play; (o) offering to a next player, in sequential order, the opportunity to be a shooter for a new round of a game and performing operation (u); (p) determining if a bet is a losing bet by the rules of resolution, and if so, removing the wager and performing operation (x); (q) determining if the roll outcome number is the point number, and if so, performing operation (s); (r) determining if a bet is a losing bet by the rules of resolution, and if so, removing the wager and performing operation (x); (s) considering the made point number to be the stay number; (t) considering a bet to be unresolved per a predetermined payout schedule for a winning outcome as defined by the rules of resolution and the bet remaining active and in play; (u) allowing the simulation of a roll of the dice one or more times during a come-out phase until a point number is established; (v) determining if the point number matches the stay number, and if so, providing a payout per a predetermined payout schedule and performing operation (x); (w) removing the wager of a bet defined as a losing bet by the rules of resolution; and (x) completing a bet, ending the method and continuing the round per standard rules of play for a round of casino craps.

The above aspects can also be obtained by a method that includes: (a) providing an image of two identical standard six-sided dice; (b) providing an image of a gaming table; (c) providing wager box areas on the image of the gaming table for standard craps bets and bets of the present invention; (e) offering to a player the opportunity to roll the dice; (f) considering a player to be the shooter when he or she rolls the dice; (g) allowing the simulation of a roll of the dice one or more times during a come-out phase until a point number is established; (h) receiving a wager from a player for at least one bet of a first set of bets; (i) allowing the simulation of a roll of the dice during a point phase to produce a roll outcome number; (j) determining if the roll outcome number is at least one of a predetermined first group of numbers, and if not, offering a player the option to increase a wager on any existing bet received in operation (h), or initiate a wager for an additional bet of a set of bets (if not previously initiated) and performing operation (i); (k) determining if the roll outcome number is the point number, and if so, removing the wager of a bet defined as a losing bet by the rules of resolution and performing operation (z); (l) considering the specific combination of the roll outcome number to now be the SOX combination; (m) considering a bet to be unresolved per a predetermined payout schedule for a winning outcome as defined by the rules of resolution and the bet remaining active and in play; (n) offering to a next player, in sequential order, the opportunity to be a shooter for a new round of a game; (o) allowing the simulation of a roll of the dice during a come-out phase to produce a roll outcome number; (p) determining if the roll outcome number is at least one of a predetermined second group of numbers, and if so, performing operation (o); (q) determining if the roll outcome number is at least one of a predetermined third group of numbers, and if so, removing the wager of a bet defined as a losing bet by the rules of resolution and performing operation (z); (r) determining if a bet is at least one of a predetermined second set of bets, and if so, performing operation (u); (s) determining if the specific combination of the roll outcome number matches the SOX combination, and if so, performing operation (u); (t) performing operation (o); (u) determining if wager is located on the end line (in the final position) of a bets corresponding wager box area, and if so, performing operation (y); (v) offering a player the option to receive a payout for a bet, and if chosen, performing operation (y); (w) repositioning a wager to the next line position in a bets corresponding wager box area; (x) performing operation (o); (y) providing a payout per a predetermined payout schedule for a bet defined as a winning bet by the rules of resolution; (z) completing a bet, ending the method and continuing the round per standard rules of play for a round of casino craps.

The above aspects can also be obtained by an apparatus that includes (a) an electronic input device; (b) an electronic output device; (c) a processing unit adapted to operate with the input device and the output device, the processing unit executing instructions to perform: (d) provide an image of two identical standard six-sided dice; (e) provide an image of a gaming table; (f) providing wager box areas on the image of the gaming table for standard craps bets and bets of the present invention; (g) conduct a casino craps game; (h) offer to a player the opportunity to roll the dice; (i) consider a player to be the shooter when he or she rolls the dice; (j) allow the simulation of a roll of the dice one or more times during a come-out phase until a point number is established; (k) receive a wager for at least one bet of a first set of bets; (l) allow the simulation of a roll of the dice during a point phase to produce a roll outcome number; (m) determine if the roll outcome number is at least one of a predetermined first group of numbers, and if not, offer a player the option to increase a wager on any existing bet received in operation (k), or initiate a wager for an additional bet of a set of bets (if not previously initiated) and perform operation (l); (n) determine if a bet is at least one of a predetermined second set of bets, and if so, perform operation (t); (o) determine if the roll outcome number is the point number, and if so, perform operation (s); (p) consider the made point number to be the stay number; (q) consider a bet to be unresolved per a predetermined payout schedule for a winning outcome as defined by the rules of resolution and the bet remains active and in play; (r) offer to a next player, in sequential order, the opportunity to be a shooter for a new round of a game and perform operation (x); (s) determine if a bet is a losing bet by the rules of resolution, and if so, removing the wager and perform operation (aa); (t) determine if the roll outcome number is the point number, and if so, perform operation (v); (u) determine if a bet is a losing bet by the rules of resolution, and if so, remove the wager and perform operation (aa); (v) consider the made point number to be the stay number; (w) consider a bet to be unresolved per a predetermined payout schedule for a winning outcome as defined by the rules of resolution and the bet remains active and in play; (x) allow the simulation of a roll of the dice one or more times during a come-out phase until a point number is established; (y) determine if the point number matches the stay number, and if so, provide a payout per a predetermined payout schedule and perform operation (aa); (z) remove the wager of a bet defined as a losing bet by the rules of resolution; and (aa) complete a bet, end the method and continue the round per standard rules of play for a round of casino craps.

The above aspects can also be obtained by an apparatus that includes (a) an electronic input device; (b) an electronic output device; (c) a processing unit adapted to operate with the input device and the output device, the processing unit executing instructions to perform: (d) provide an image of two identical standard six-sided dice; (e) provide an image of a gaming table; (f) providing wager box areas on the image of the gaming table for standard craps bets and bets of the present invention; (g) conduct a casino craps game; (h) offer to a player the opportunity to roll the dice; (i) consider a player to be the shooter when he or she rolls the dice; (j) allow the simulation of a roll of the dice one or more times during a come-out phase until a point number is established; (k) receive a wager from a player for at least one bet of a first set of bets; (l) allow the simulation of a roll of the dice during a point phase to produce a roll outcome number; (m) determine if the roll outcome number is at least one of a predetermined first group of numbers, and if not, offer a player the option to increase a wager on any existing bet received in operation (k), or initiate a wager for an additional bet of a set of bets (if not previously initiated) and perform operation (l); (n) determine if the roll outcome number is the point number, and if so, remove the wager of a bet defined as a losing bet by the rules of resolution and perform operation (cc); (o) consider the specific combination of the roll outcome number to now be the SOX combination; (p) consider a bet to be unresolved per a predetermined payout schedule for a winning outcome as defined by the rules of resolution and the bet remains active and in play; (q) offer to a next player, in sequential order, the opportunity to be a shooter for a new round of a game; (r)

allow the simulation of a roll of the dice during a come-out phase to produce a roll outcome number; (s) determine if the roll outcome number is at least one of a predetermined second group of numbers, and if so, perform operation (r); (t) determine if the roll outcome number is at least one of a predetermined third group of numbers, and if so, remove the wager of a bet defined as a losing bet by the rules of resolution and perform operation (cc); (u) determine if a bet is at least one of a predetermined second set of bets, and if so, perform operation (x); (v) determine if the specific combination of the roll outcome number matches the SOX combination, and if so, perform operation (x); (w) perform operation (r); (x) determine if wager is located on the end line (in the final position) of a bets corresponding wager box area, and if so, perform operation (bb); (y) offer a player the option to receive a payout for a bet, and if chosen, perform operation (bb); (z) reposition a wager to the next line position in a bets corresponding wager box area; (aa) performing operation (r); (bb) provide a payout per a predetermined payout schedule for a bet defined as a winning bet by the rules of resolution; (cc) complete a bet, end the method and continue the round per standard rules of play for a round of casino craps.

These together with other aspects and advantages which will be subsequently apparent, reside in the details of construction and operation as more fully hereinafter described and claimed, reference being had to accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings in which.

DESCRIPTION OF PREFERRED EMBODIMENTS

Figure 1:
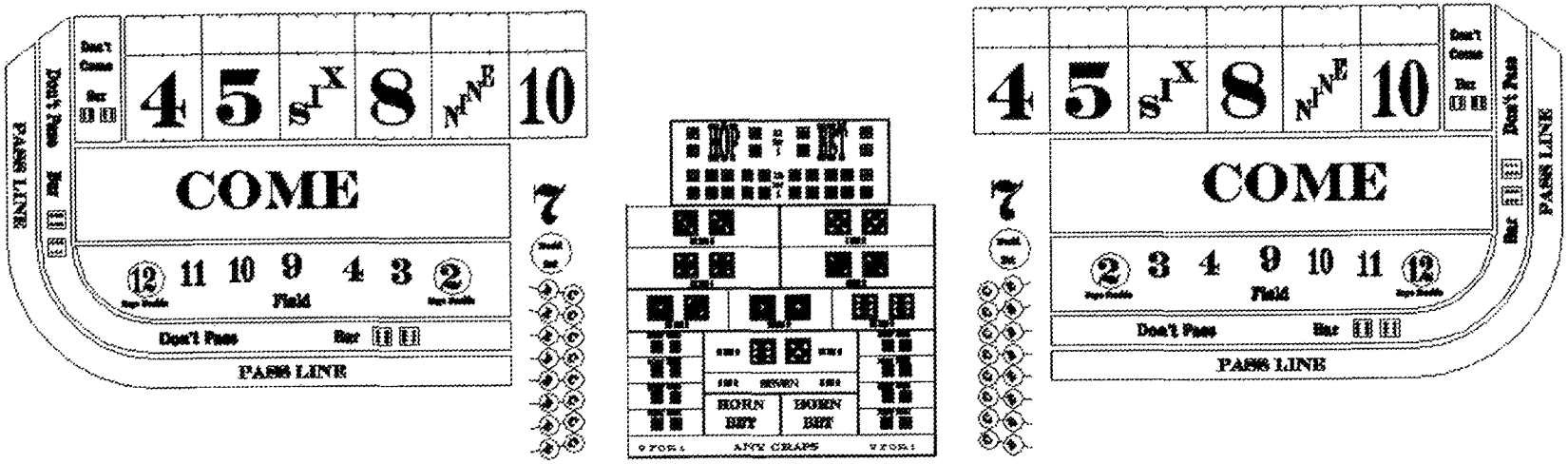
FIG. 1 is an illustration of a prior art casino craps screen lay-out.

Reference will now be made in detail to the presently preferred embodiments of the invention, examples of which are illustrated in the accompanying drawings, wherein like reference numerals refer to like elements throughout.

The present general inventive concept relates to a method, apparatus, and computer readable storage to implement a plurality of side bets for a casino craps game. Casino craps is known in the art and is described in U.S. Pat. No. 6,394,901, which is incorporated by reference herein in its entirety.

The side bets of the present invention are all four different, yet follow many similar rules of resolution. They can be categorized into two types, with each type including two bets. The first type is the STAY bets, consisting of a Point-Stay bet and a Seven-Stay bet. The second type is the Seven-Out bets, consisting of a Seven-Out-any-Seven-win (SOSI) bet and a Seven-Out-eXact-seven-win (SOX) bet. All of the bets are multiple stage bets, which upon a win outcome in stage one, the bets are unresolved, but remain in play and active advancing to additional stages which produce larger payout ratios for a win.

Table 2a summarizes the rules of resolution for the Point-Stay bet and Seven-Stay bet, by stage:

TABLE 2a

| Bet | Stage | Phase | Winning outcome(s) | Losing outcome(s) | Unresolved outcome(s) |
|---|---|---|---|---|---|
| Point-Stay | One | Point | Making the Point # | Seven-out | 2, 3, 11, 12 and Place #'s other than the Point # |
| Point-Stay | Two | Come-out | Establishing a Point # that matches the Stay # | Establishing a Point # not matching the Stay # | 2, 3, 11 or 12 |
| Seven-Stay | One | Point | Seven-out | Making the Point # | 2, 3, 11, 12 and Place #'s other than the Point # |
| Seven-Stay | Two | Come-out | Establishing a Point # That matches the Stay # | Establishing a Point # not matching the Stay # | 2, 3, 11 or 12 |

Table 2b summarizes the rules of resolution for the SOSI bet and SOX bet, by stage:

TABLE 2b

| Bet | Stage | Phase | Winning outcome(s) | Losing Outcome(s) | Unresolved outcome(s) |
|---|---|---|---|---|---|
| SOSI | One | Point | Seven-out | Point # | Non-Point and Non-7 |
| SOSI | Two, Three, Four and Five | Come-out | Any 7 | Establishing a Point # | 2, 3, 11 or 12 |
| SOX | One | Point | Seven-out | Point # | Non-Point and Non-7 |
| SOX | Two and Three | Come-out | Specific combination matching the Seven-out (1-6 or 2-5 or 3-4) | Establishing a Point # | 2, 3, 11, 12 or Specific combination not matching the Seven-out |

Table 2b notes:

The winning outcomes for either of the bets are not required to be rolled consecutively to proceed to the following stage. An unlimited number of unresolved outcome numbers cart be rolled in between the winning outcome numbers in the various stages.

The plurality of side bets of the invention are optional and would be initiated during the point phase (after a point number has been established). The wager amount must follow the minimum, proper increment and maximum amounts allowed per the game facilitator's rules. Once initiated, the wager amounts can only be increased during the point phase, prior to either the point number or a seven-out being rolled. Once initiated a player cannot remove the wagers, the wager amounts cannot be decreased and the wagers cannot be turned off.

Figure 4:
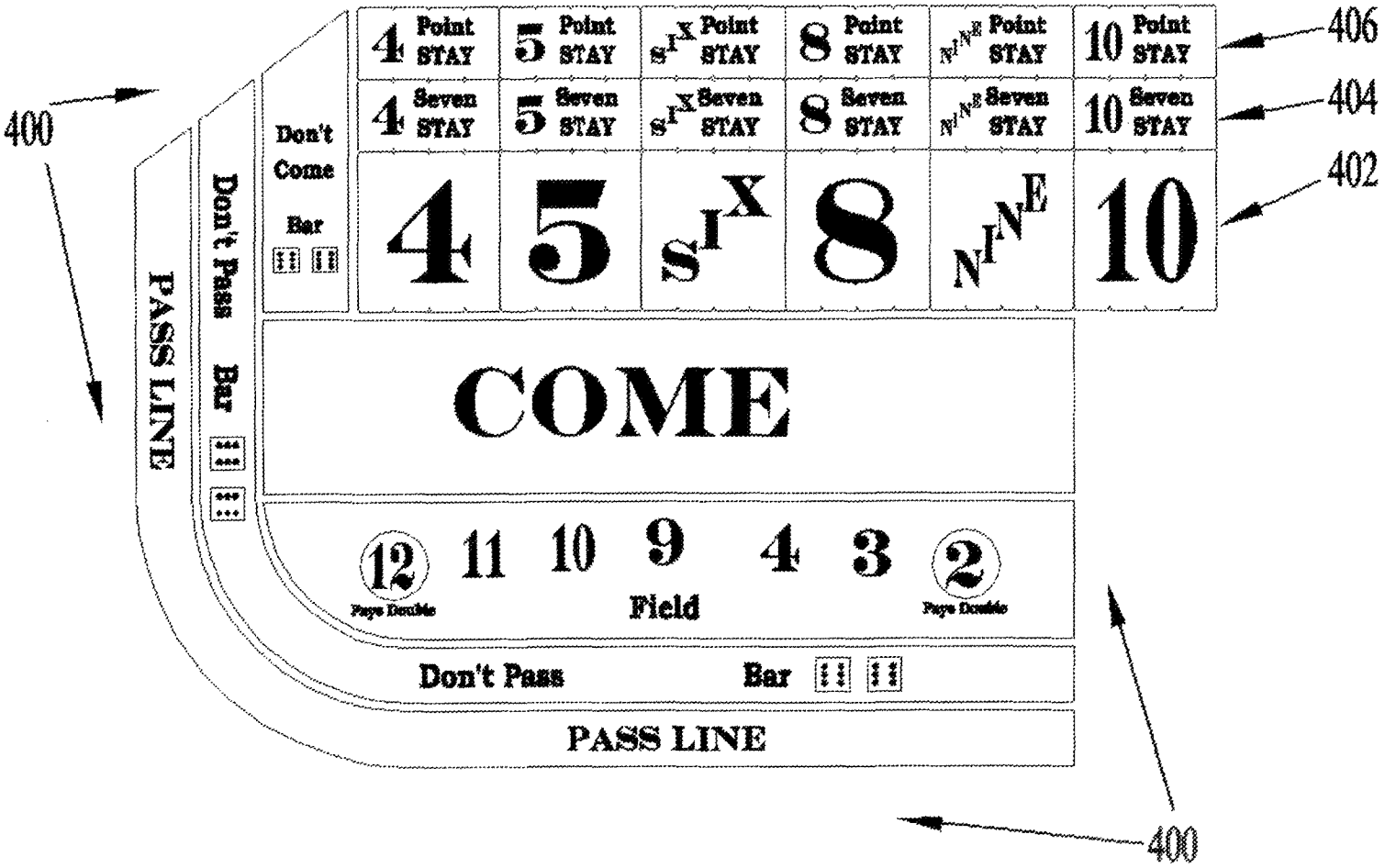
FIG. 4 is an illustration of the end section of a casino craps screen lay-out incorporating the Point-Stay bet and Seven-Stay bet wager boxes used for the present invention, according to an embodiment of the present invention.

FIG. 4 is an illustration of the end section of a casino craps screen lay-out incorporating the Point-Stay bet and Seven-Stay bet wager boxes used for the present invention, according to an embodiment of the present invention.

The casino craps layout is shown of the left end section of the overall layout, including the wager boxes of a prior art layout area 400, and includes the preferred embodiment of the present invention of the six Point-Stay bet wager boxes 404 and the preferred embodiment of the present invention of the six Seven-Stay bet wager boxes 406 located just above the six prior art place number wager boxes 402.

Figure 5:
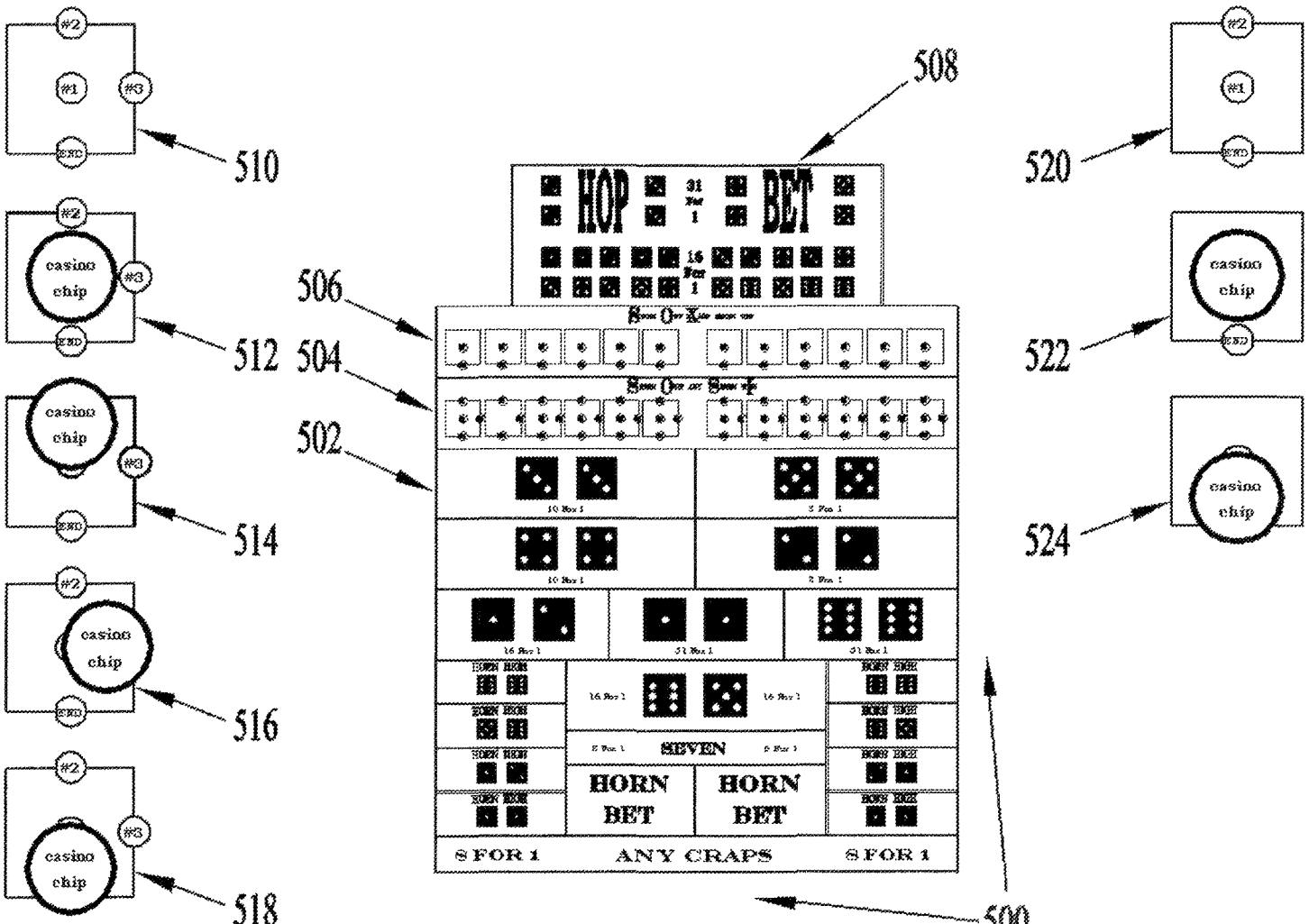
FIG. 5 is an illustration of the center section of a casino craps screen lay-out incorporating the SOSI bet and SOX bet wager areas used for the present invention, according to an embodiment of the present invention.

FIG. 5 is an illustration of the center section of a casino craps screen lay-out incorporating the SOSI bet and SOX bet wager areas used for the present invention, according to an embodiment of the present invention.

The casino craps layout is shown of the center section including the wager boxes of a prior art proposition bet layout area 500, and includes the preferred embodiment of the present invention of the SOSI bet wager area 504 and the preferred embodiment of the present invention of the SOX bet wager area 506 located above the hardways wager boxes 502, and below the hop bet wager area 508.

Figure 2:
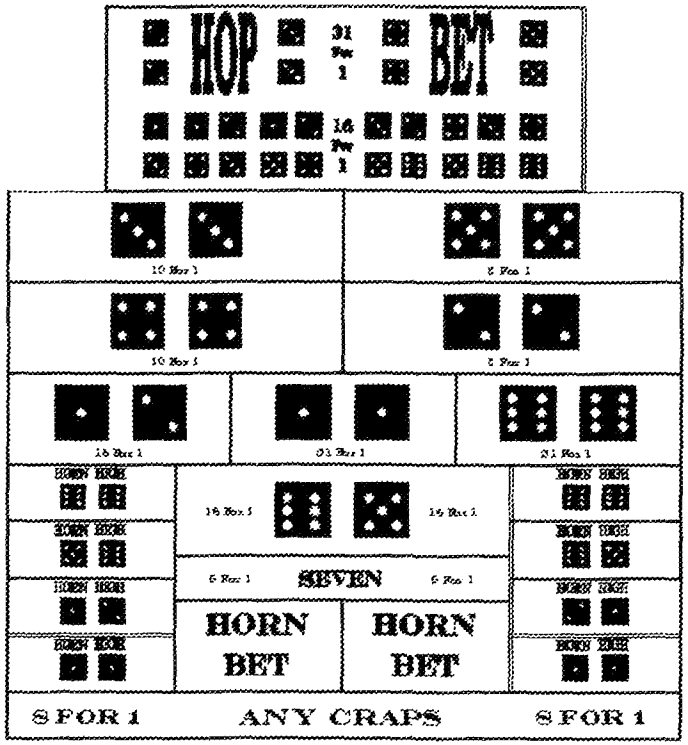
FIG. 2 is a close up view illustration of the proposition (center) section of FIG. 1.
Figure 3:
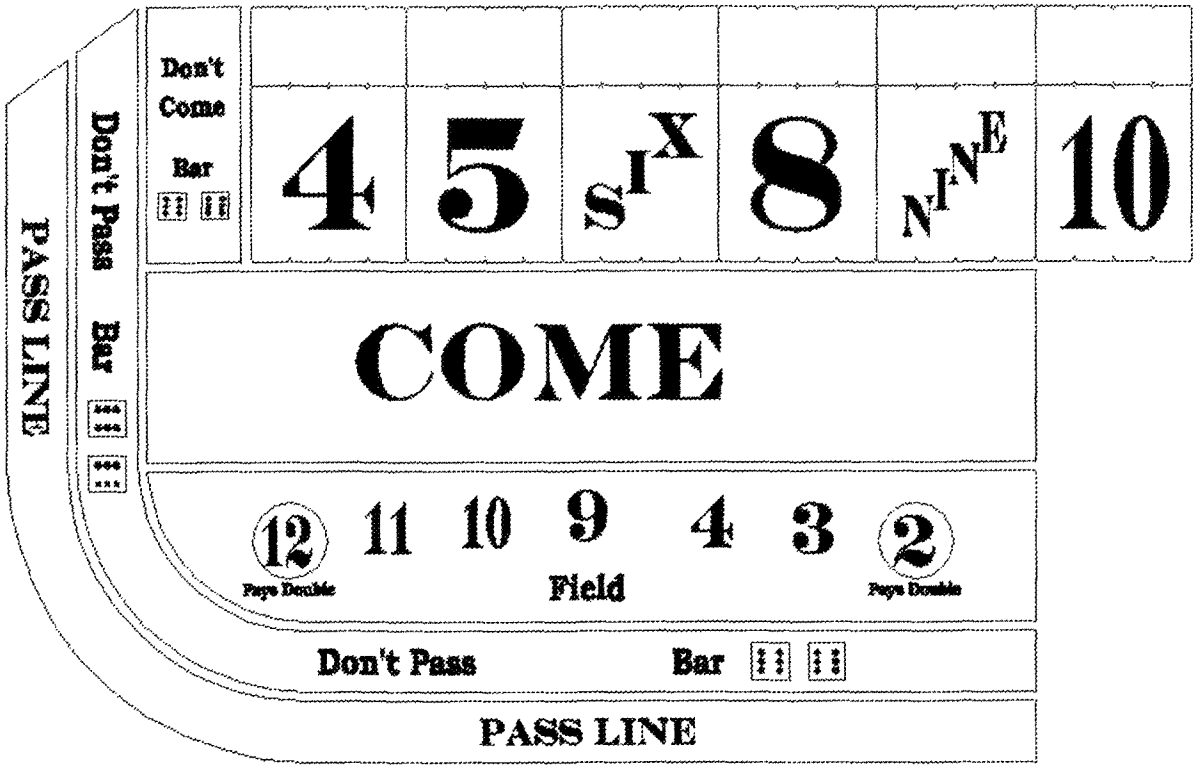
FIG. 3 is a close up view illustration of the left (end) section of FIG. 1.

The progression of both the SOSI bet and the SOX bet is tracked without the use of a second specific area or indicator, for monitoring a progression of events, as Moore discloses in U.S. Pat. No. 5,829,748 (FIG. 1, 1A; col. 6, lines 48-53, wherein chips are placed on numbered areas as the game progresses). Further, the progression of the SOSI bet and the SOX bet is tracked without the use of a display area separate from the jackpot wagering area, as Hobert discloses in U.S. Pat. No. 5,728,002 (FIG. 4; col 8, lines 19-43, wherein sequences are tracked by match indicators are used to track jackpot sequence wagers). As well, the progression of the SOSI bet and the SOX bet is tracked without the use of any type of device or chip with no monetary value being utilized for monitoring bets, as Ornstein discloses in U.S. Pat. No. 5,718,431 (FIG. 2, 5; col. 3, lines 1-10, wherein markers and chips are utilized for monitoring consecutive play bets). Finally, the progression of the SOSI bet and SOX bet is tracked without the use of any type of method of utilizing a separate player betting area and a corresponding wager area, as Staci discloses in U.S. Pat. No. 7,100,919.

The progression of the different stages of a SOSI bet and a SOX bet is tracked by simply repositioning a players wager within the wager box area, directed by the game facilitator, and overlapping the different boundary lines. Each of the bets utilizes one boundary line as an "end" line, which is the final position used to mark a bets limit of play by the allowed number of stages (five total for the SOSI bet, three total for the SOX bet). Each bets corresponding wager box area (there is a separate wager area for the SOSI bets and a separate area for the SOX bets) has a central area for the initial placement of the wager, and the wager remains in this location prior to the first stage (Seven-Out) and the second stage (any-Seven-win #1 or eXact-seven-win #1) for each of the bets. The central area is large enough so a wager chip of standard size can be located within the boundary lines without overlapping any of them.

The SOSI bet wager area also includes utilizing a boundary line for prior to the third stage (any-Seven-win #2), as well as a boundary line for prior to the fourth stage (any-Seven-win #3).

Examples of the progression of the different stages of a SOSI bet are shown for a wager position prior to a bet being initiated 510, after a bet is initiated (prior to the first stage) and following the roll outcome of a seven-out (prior to the second stage) 512, following the first roll outcome number that is a 7 (prior to the third stage) 514, following the second roll outcome number that is a 7 (prior to the fourth stage) 516, and following the third roll outcome number that is a 7 (prior to the fifth and last stage) 518. The fourth roll outcome number of any 7 (not necessarily consecutive) completes (ends) a bet and the wager is removed.

Examples of the progression of the different stages of a SOX bet are shown for a wager position prior to a bet being initiated 520, after a bet is initiated (prior to the first stage) and following the roll outcome of a seven-out (prior to the second stage) 522, following the first roll outcome number that is a specific combination of 7 (prior to the third stage and last stage) 524. The second roll outcome number of a specific combination of 7 (not necessarily consecutive) completes (ends) a bet and the wager is removed.

Figure 6:
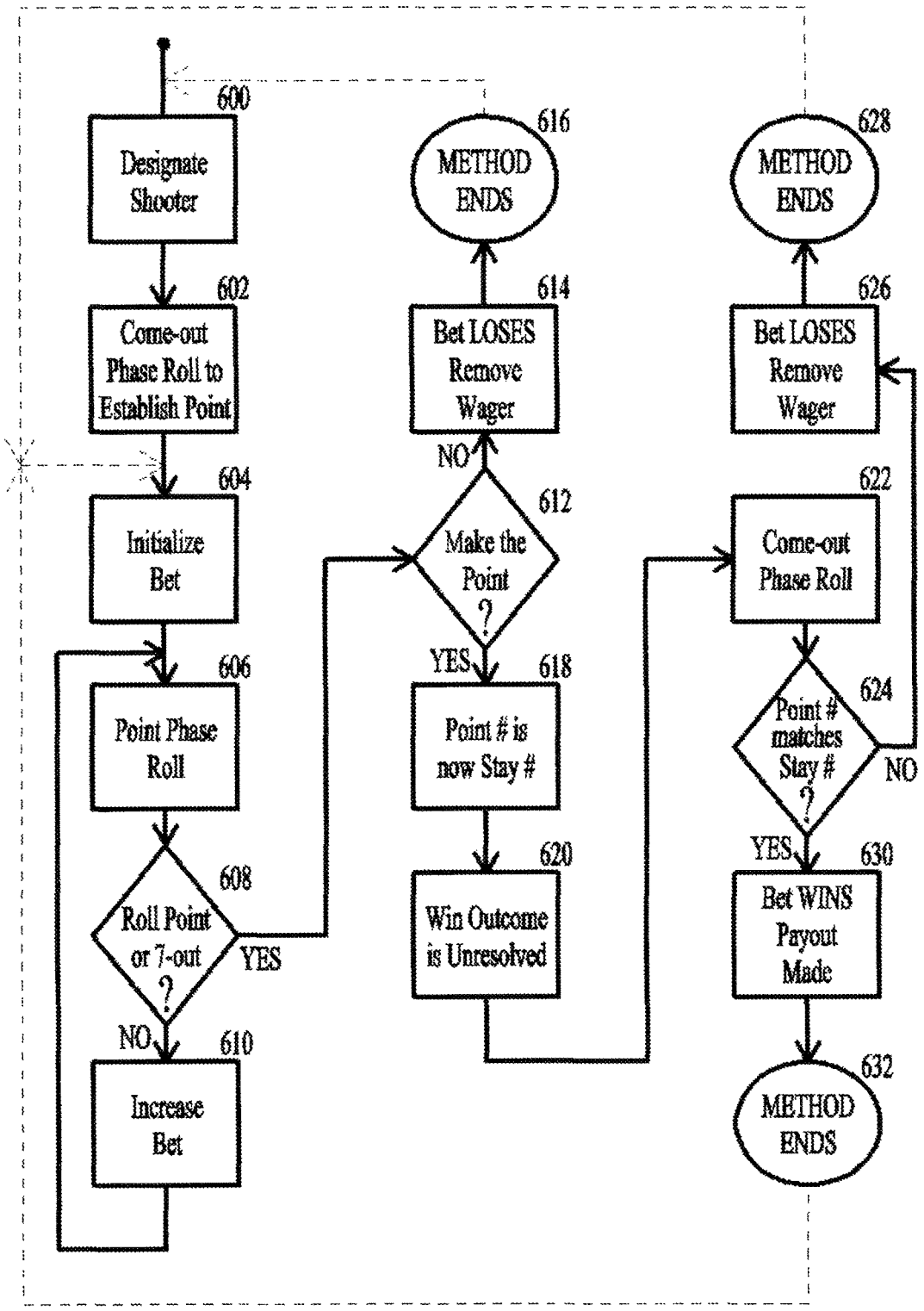
FIG. 6 is a flow chart illustrating the method to implement a Point-Stay bet, according to an embodiment of the present invention.

FIG. 6 is a flow chart illustrating the method to implement a Point-Stay bet, according to an embodiment of the present invention.

The method begins with operation 600, wherein a new player is offered the opportunity to roll the dice, with the player then being considered the shooter for the remainder of the round. The start of the method coincides with the start of a new round of a casino craps game.

Some of various electronic game devices and/or other apparatus for playing casino craps can accommodate multiple simultaneous players and some can only accommodate one player. For simplicity, this description assumes there are multiple players. If there is only one player, any reference to a "new" player is considered to be the same player.

After a shooter has been designated in operation 600, the method proceeds to operation 602 wherein the shooter rolls the dice one or more times during a come-out phase until the roll outcome number is one of any of the numbers 4, 5, 6, 8, 9 or 10, with the roll outcome number being considered a point number. Upon establishing a point number, the round moves to the point phase.

From operation 602, the method proceeds to operation 604, wherein a wager is received from a player for a Point-Stay bet. This is considered the start of stage one of a bet. Of the six Point-Stay bet wager box locations associated with the place numbers the Point-Stay bet wager box that is associated with the current point number is the only one that is available to accept wagers. The wager amount must follow the minimum and maximum amounts allowed per the game facilitator's rules.

From operation 604, the method proceeds to operation 606, wherein the shooter rolls the dice to produce a point phase roll outcome number used in determining the outcome of a bet.

From operation 606, the method proceeds to operation 608, which determines if the roll outcome number is one of either of the numbers 7 or the point number.

If, in operation 608, it is determined that the roll outcome number is not one of either of the numbers 7 or the point number, then the method proceeds to operation 610, wherein a player is given the option to increase the wager amount of an existing Point-Stay bet previously initiated in operation 604. The wager amount must follow the proper increment and maximum amounts allowed per the game facilitator's rules.

From operation 610, the method proceeds to operation 606, described above.

If, in operation 608, it is determined that the roll outcome number is one of either of the numbers 7 or the point number, then the method proceeds to operation 612, which determines if the roll outcome number is the point number.

If, in operation 612, it is determined that the roll outcome number is not the point number, therefore the roll outcome number is a 7, the method proceeds to operation 614, wherein a player loses a bet, the original wager is removed from play by the game facilitator and a bet is completed.

From operation 614, the method proceeds to operation 616, wherein the method ends and the current round ends normally. If a new Point-Stay bet is to be initialized, the method would begin at operation 600, described above.

If, in operation 612, it is determined that the roll outcome number is the point number, the method proceeds to operation 618, which considers the preceding point number to be considered the stay number.

From operation 618, the method proceeds to operation 620, wherein a Point-Stay bet is unresolved, ending stage one of the bet, a wager stays active and in play, and the bet moves into stage two.

From operation 620, the method proceeds to operation 622, wherein the shooter rolls the dice one or more times during a come-out phase until the roll outcome number is any one of the numbers 4, 5, 6, 8, 9 or 10, to establish a point number.

From operation 622, the method proceeds to operation 624, which determines if the point number matches the stay number.

If, in operation 624, it is determined that the point number does not match the stay number, the method proceeds to operation 626, wherein a player loses a bet, the original wager is removed from play by the game facilitator and a bet is completed.

From operation 626, the method proceeds to operation 628, wherein the method ends and the current round continues normally. If a new Point-Stay bet is to be initialized the method would begin at operation 604, described above.

If, in operation 624, it is determined that the point number matches the stay number, the method proceeds to operation 630, wherein a player wins a bet, a payout is made per a predetermined payout schedule, the original wager is removed from play by the game facilitator and a bet is completed.

From operation 630, the method proceeds to operation 632, wherein the method ends and the current round continues normally. If a new Point-Stay bet is to be initialized the method would begin at operation 604, described above.

Figure 7:
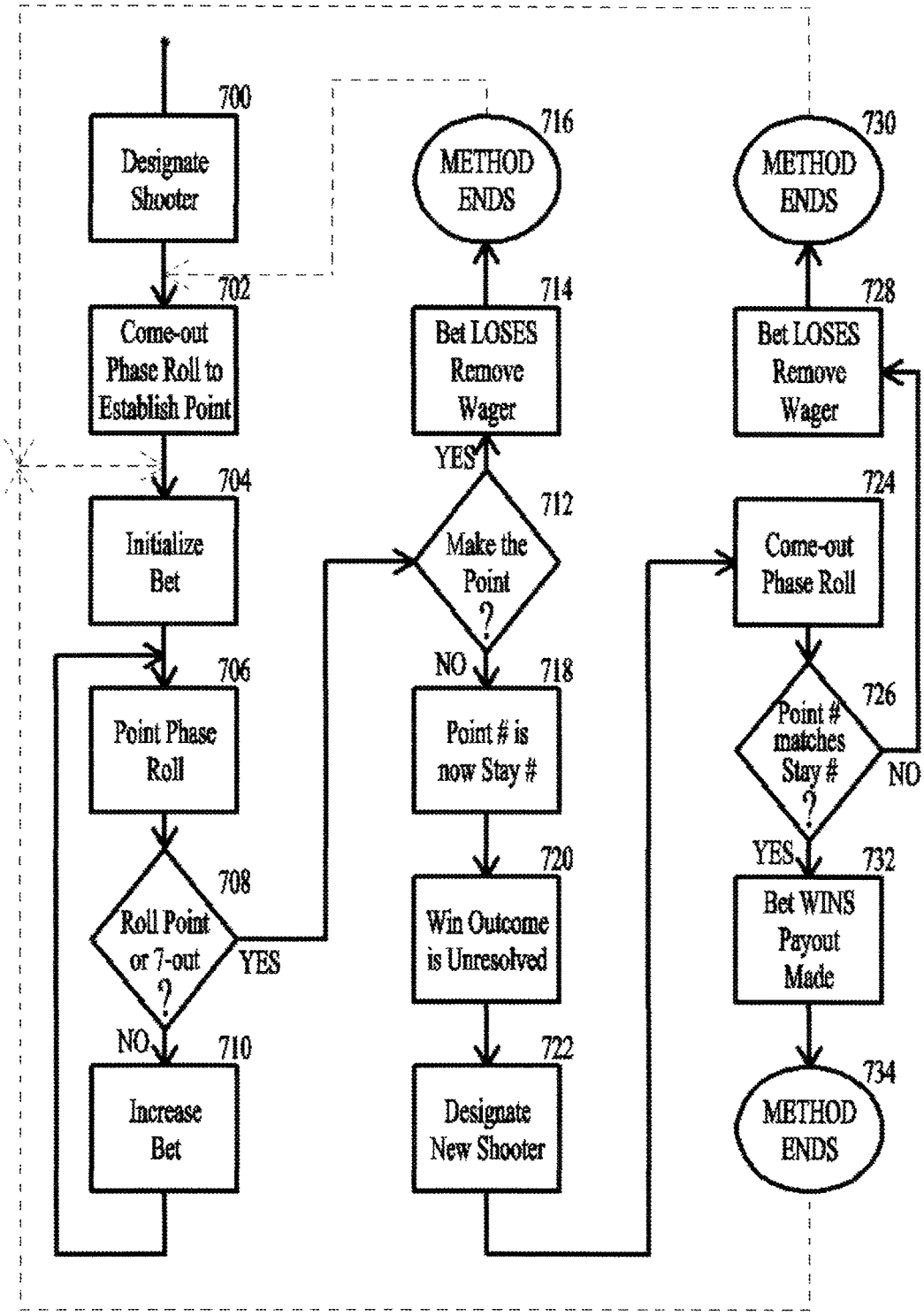
FIG. 7 is a flow chart illustrating the method to implement a Seven-Stay bet, according to an embodiment of the present invention.

FIG. 7 is a flow chart illustrating the method to implement a Seven-Stay bet, according to an embodiment of the present invention.

The method begins with operation 700, wherein a new player is offered the opportunity to roll the dice, with the player then being considered the shooter for the remainder of the round. The start of the method coincides with the start of a new round of a casino craps game.

Some of various electronic game devices and/or other apparatus for playing casino craps can accommodate multiple simultaneous players and some can only accommodate one player. For simplicity, this description assumes there are multiple players. If there is only one player, any reference to a "new" player is considered to be the same player.

After a shooter has been designated in operation 700, the method proceeds to operation 702 wherein the shooter rolls the dice one or more times during a come-out phase until the roll outcome number is one of any of the numbers 4, 5, 6, 8, 9 or 10, with that roll outcome number being considered a point number. Upon establishing a point number, the round moves to the point phase.

From operation 702, the method proceeds to operation 704, wherein a wager is received from a player for a Seven-Stay bet. This is considered the start of stage one of a bet. Of the six Seven-Stay bet wager box locations associated with the place numbers the Seven-Stay bet wager box that is associated with the current point number is the only one that is available to accept wagers. The wager amount must follow the minimum and maximum amounts allowed per the game facilitator's rules.

From operation 704, the method proceeds to operation 706, wherein the shooter rolls the dice to produce a point phase roll outcome number used in determining the outcome of a bet.

From operation 706, the method proceeds to operation 708, which determines if the roll outcome number is one of either of the numbers 7 or the point number.

If, in operation 708, it is determined that the roll outcome number is not one of either of the numbers 7 or the point number, then the method proceeds to operation 710, wherein a player is given the option to increase the wager amount of an existing Seven-Stay bet previously initiated in operation 704. The wager amount must follow the proper increment and maximum amounts allowed per the game facilitator's rules.

From operation 710, the method proceeds to operation 706, described above.

If, in operation 708, it is determined that the roll outcome number is one of either of the numbers 7 or the point number, then the method proceeds to operation 712, which determines if the roll outcome number is the point number.

If, in operation 712, it is determined that the roll outcome number is the point number the method proceeds to operation 714, wherein a player loses a bet, the original wager is removed from play by the game facilitator and a bet is completed.

From operation 714, the method proceeds to operation 716, wherein the method ends and the current round continues normally. If a new Seven-Stay bet is to be initialized, the method would begin at operation 702, described above.

If, in operation 712, it is determined that the roll outcome number is not the point number, therefore the roll outcome number is a 7, the method proceeds to operation 718, which considers the preceding point number to be considered the stay number.

From operation 718, the method proceeds to operation 720, wherein a Seven-Stay bet is unresolved, ending stage one of the bet, a wager stay active and in play, and the bet moves into stage two.

From operation 720, the method proceeds to operation 722, wherein a new player is offered the opportunity to roll the dice to start a new round, with the player then being considered the shooter for the remainder of the new round.

From operation 722, the method proceeds to operation 724, wherein the shooter rolls the dice one or more times during a come-out phase until the roll outcome number is any one of the numbers 4, 5, 6, 8, 9 or 10, to establish a point number.

From operation 724, the method proceeds to operation 726, which determines if the point number matches the stay number.

If, in operation 726, it is determined that the point number does not match the stay number, the method proceeds to operation 728, wherein a player loses a bet, the original wager is removed from play by the game facilitator and a bet is completed.

From operation 728, the method proceeds to operation 730, wherein the method ends and the current round continues normally. If a new Seven-Stay bet is to be initialized the method would begin at operation 704, described above.

If, in operation 726, it is determined that the point number matches the stay number, the method proceeds to operation 732, wherein a player wins a bet, a payout is made per a predetermined payout schedule, the original wager is removed from play by the game facilitator and a bet is completed.

From operation 732, the method proceeds to operation 734, wherein the method ends and the current round continues normally. If a new Seven-Stay bet is to be initialized the method would begin at operation 704, described above.

Figure 8:
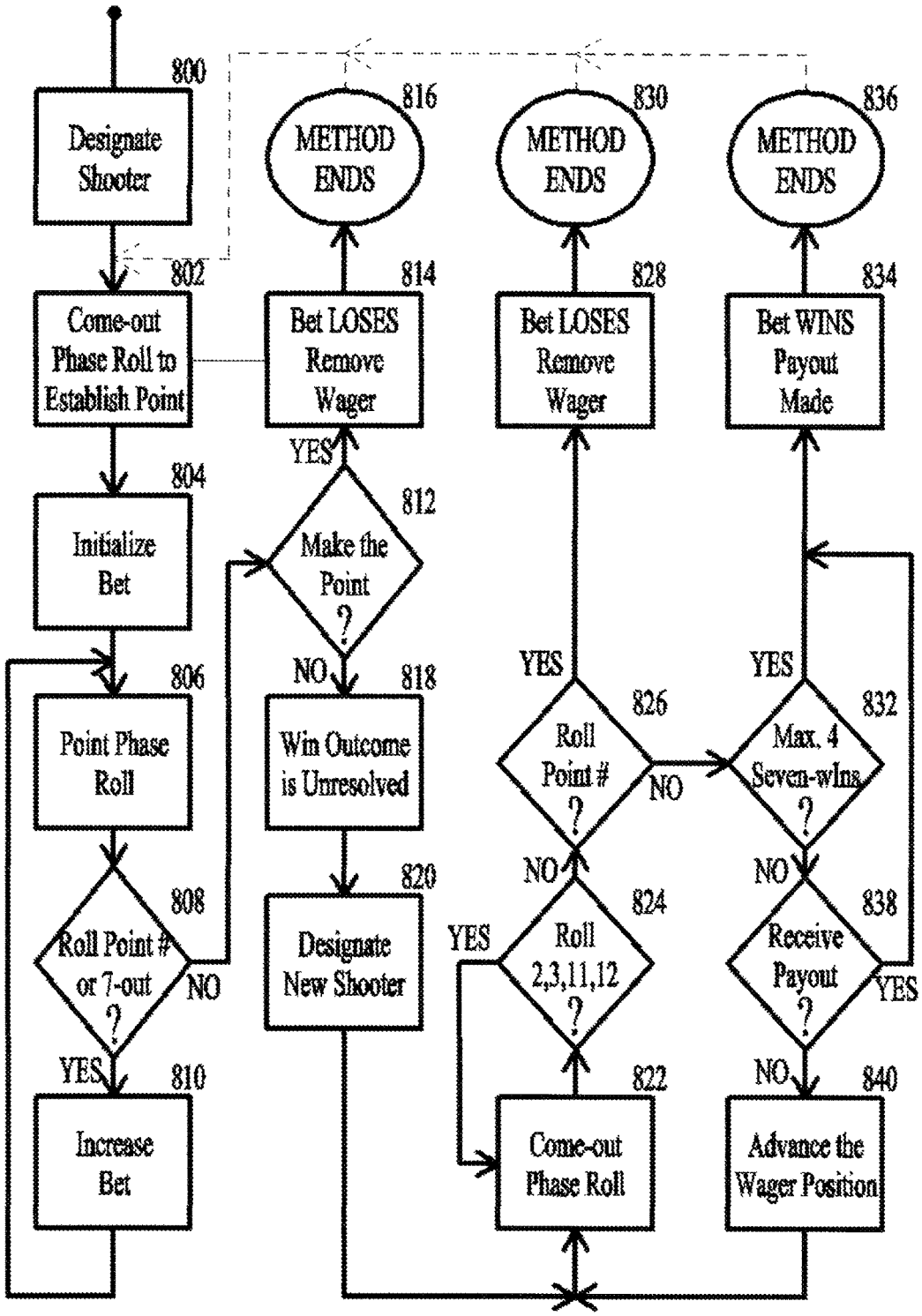
FIG. 8 is a flow chart illustrating the method to implement a SOSI bet, according to an embodiment of the present invention.

FIG. 8 is a flow chart illustrating the method to implement a SOSI bet, according to an embodiment of the present invention.

The method begins with operation 800, wherein a new player is offered the opportunity to roll the dice, with the player then being considered the shooter for the remainder of the round. The start of the method coincides with the start of a new round of a casino craps game.

Some of various electronic game devices and/or other apparatus for playing casino craps can accommodate multiple simultaneous players and some can only accommodate one player. For simplicity, this description assumes there are multiple players. If there is only one player, any reference to a "new" player is considered to be the same player.

After a shooter has been designated in operation 800, the method proceeds to operation 802 wherein the shooter rolls the dice one or more times during a come-out phase until the roll outcome number is one of any of the numbers 4, 5, 6, 8, 9 or 10, with that roll outcome number being considered a point number. Upon establishing a point number, the round moves to the point phase.

From operation 802, the method proceeds to operation 804, wherein a wager is received from a player for a SOSI bet. This is considered the start of stage one of a bet. When the wager is initiated, the wager is placed within the SOSI bet wager box in the center location to indicate that a bet is in stage one. The wager amount must follow the minimum and maximum amounts allowed per the game facilitator's rules.

From operation 804, the method proceeds to operation 806, wherein the shooter rolls the dice to produce a point phase roll outcome number used in determining the outcome of a bet.

From operation 806, the method proceeds to operation 808, which determines if the roll outcome number is one of either of the numbers 7 or the point number.

If, in operation 808, it is determined that the roll outcome number is not one of either of the numbers 7 or the point number, then the method proceeds to operation 810, wherein a player is given the option to increase the wager amount of an existing SOSI bet previously initiated in operation 804. The wager amount must follow the proper increment and maximum amounts allowed per the game facilitator's rules.

From operation 810, the method proceeds to operation 806, described above.

If, in operation 808, it is determined that the roll outcome number is one of either of the numbers 7 or the point number, then the method proceeds to operation 812, which determines if the roll outcome number is the point number.

If, in operation 812, it is determined that the roll outcome number is the point number the method proceeds to operation 814, wherein a player loses a bet, the original wager is removed from play by the game facilitator and a bet is completed.

From operation 814, the method proceeds to operation 816, wherein the method ends and the current round continues normally. If a new SOSI bet is to be initialized, the method would begin at operation 802, described above.

If, in operation 812, it is determined that the roll outcome number is not the point number, therefore the roll outcome number is a 7, the method proceeds to operation 818, wherein a SOSI bet is unresolved, ending stage one of the bet, the wager stays active and in play, and the bet moves into stage two.

From operation 818, the method proceeds to operation 820, wherein a new player is offered the opportunity to roll the dice to start a new round, with the player then being considered the shooter for the remainder of the new round.

From operation 820, the method proceeds to operation 822, wherein the shooter rolls the dice one or more times during a come-out phase until the roll outcome number is any one of the numbers 4, 5, 6, 8, 9 or 10, to establish a point number.

From operation 822, the method proceeds to operation 824, which determines if the roll outcome number is one of any of the numbers 2, 3, 11 or 12.

If, in operation 824, it is determined that the roll outcome number is one of any of the numbers 2, 3, 11 or 12, the method proceeds to operation 822, described above.

If, in operation 824, it is determined that the roll outcome number is not any of the numbers 2, 3, 11, 12, the method proceeds to operation 826, which determines if the roll outcome number is one of any of the numbers 4, 5, 6, 8, 9 or 10.

If, in operation 826, it is determined that the roll outcome number is any of the numbers 4, 5, 6, 8, 9 or 10, the method proceeds to operation 828, wherein a player loses a bet, the original wager is removed from play by the game facilitator and a bet is completed.

From operation 828, the method proceeds to 830, wherein the method ends and the current round continues normally. If a new SOSI bet is to be initialized, the method would begin at operation 802, described above.

If, in operation 826, it is determined that the roll outcome number is not any of the numbers 4, 5, 6, 8, 9 or 10, therefore the roll outcome number is a 7, the method proceeds to operation 832, which determines if the wager location is on the end line (in the final position) in the SOSI wager box area.

If, in operation 832, it is determined that bet wager location is in the final position, the method proceeds to operation 834, wherein a player wins a bet, a payout is made per a predetermined payout schedule, the original wager is removed from play by the game facilitator and a bet is completed.

From operation 834, the method proceeds to operation 836, wherein the method ends and the current round continues normally. If a new SOSI bet is to be initialized the method would begin at operation 802, described above.

If, in operation 832, it is determined that the bet wager location is not in the final position, the method proceeds to operation 838, wherein a player can receive a payout (or not) at the player's option.

If, in operation 842, it is determined that that the player wants to receive a payout, the method proceeds to operation 834, described above.

If, in operation 838, it is determined that that the player doesn't want to receive a payout, the method proceeds to operation 840, wherein a wager is relocated to the next line position in the SOSI wager box area.

From operation 840, the method proceeds to operation 828, described above.

Figure 9:
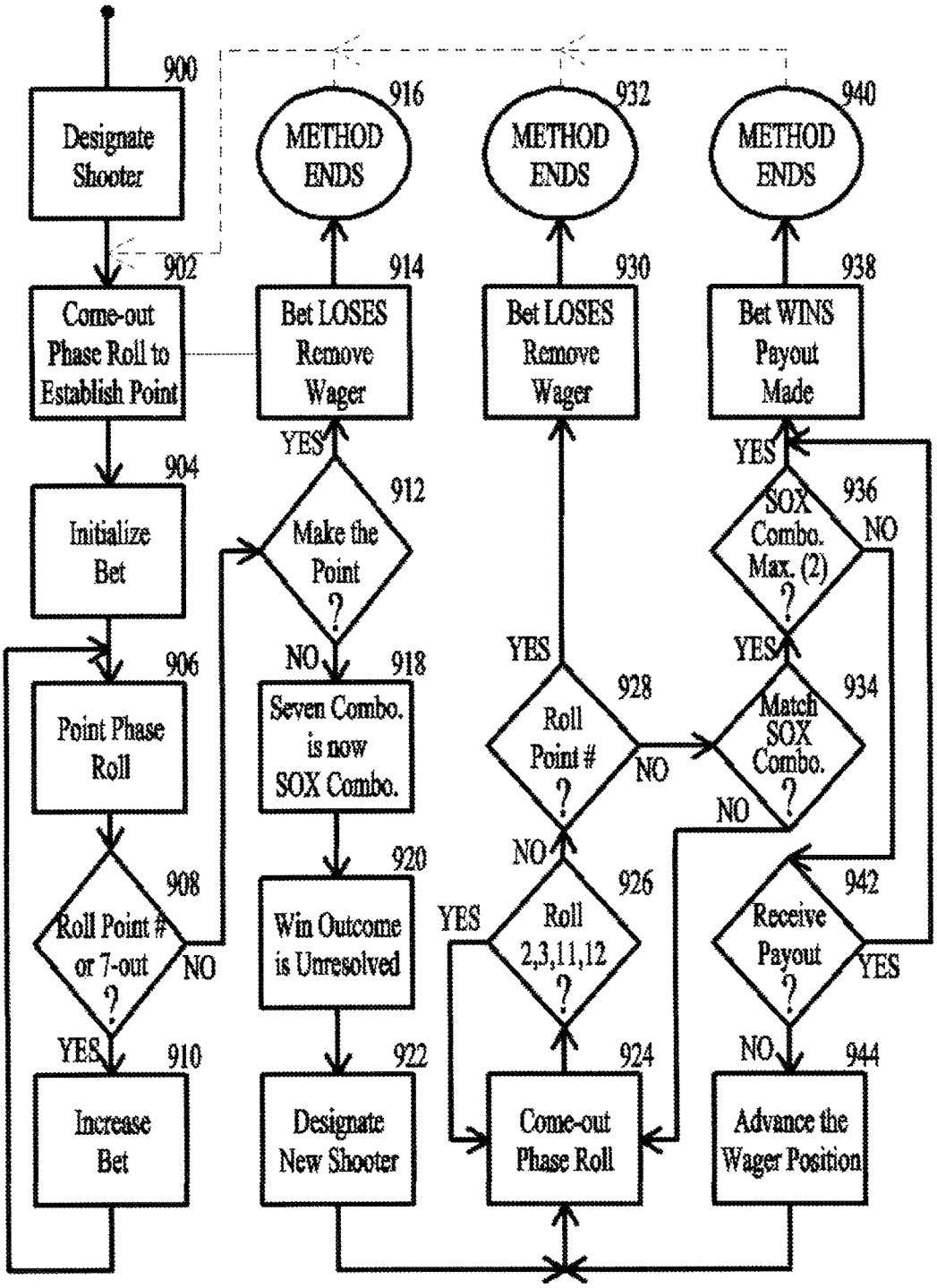
FIG. 9 is a flow chart illustrating the method to implement a SOX bet, according to an embodiment of the present invention.

FIG. 9 is a flow chart illustrating the method to implement a SOX bet, according to an embodiment of the present invention.

The method begins with operation 900, wherein a new player is offered the opportunity to roll the dice, with the player then being considered the shooter for the remainder of the round. The start of the method coincides with the start of a new round of a casino craps game.

Some of various electronic game devices and/or other apparatus for playing casino craps can accommodate multiple simultaneous players and some can only accommodate one player. For simplicity, this description assumes there are multiple players. If there is only one player, any reference to a "new" player is considered to be the same player.

After a shooter has been designated in operation 900, the method proceeds to operation 902 wherein the shooter rolls the dice one or more times during a come-out phase until the roll outcome number is one of any of the numbers 4, 5, 6, 8, 9 or 10, with that roll outcome number being considered a point number. Upon establishing a point number, the round moves to the point phase.

From operation 902, the method proceeds to operation 904, wherein a wager is received from a player for a SOSI bet. This is considered the start of stage one of a bet. When the wager is initiated, the wager is placed within the SOX bet wager box in the center location to indicate that a bet is in stage one. The wager amount must follow the minimum and maximum amounts allowed per the game facilitator's rules.

From operation 904, the method proceeds to operation 906, wherein the shooter rolls the dice to produce a point phase roll outcome number used in determining the outcome of a bet.

From operation 906, the method proceeds to operation 908, which determines if the roll outcome number is one of either of the numbers 7 or the point number.

If, in operation 908, it is determined that the roll outcome number is not one of either of the numbers 7 or the point number, then the method proceeds to operation 910, wherein a player is given the option to increase the wager amount of an existing SOX bet previously initiated in operation 904. The wager amount must follow the proper increment and maximum amounts allowed per the game facilitator's rules.

From operation 910, the method proceeds to operation 906, described above.

If, in operation 908, it is determined that the roll outcome number is one of either of the numbers 7 or the point number, then the method proceeds to operation 912, which determines if the roll outcome number is the point number.

If, in operation 912, it is determined that the roll outcome number is the point number the method proceeds to operation 914, wherein a player loses a bet, the original wager is removed from play by the game facilitator and a bet is completed.

From operation 914, the method proceeds to operation 916, wherein the method ends and the current round continues normally. If a new SOSI bet is to be initialized, the method would begin at operation 902, described above.

If, in operation 912, it is determined that the roll outcome number is not the point number, therefore the roll outcome number is a 7, the method proceeds to operation 918, wherein the specific combination of the outcome number 7 is considered the SOX combination.

From operation 918, the method proceeds to operation 920, wherein a SOX bet is unresolved, ending stage one of the bet, the wager stays active and in play, and the bet moves into stage two.

From operation 920, the method proceeds to operation 922, wherein a new player is offered the opportunity to roll the dice to start a new round, with the player then being considered the shooter for the remainder of the new round.

From operation 922, the method proceeds to operation 924, wherein the shooter rolls the dice one or more times during a come-out phase until the roll outcome number is any one of the numbers 4, 5, 6, 8, 9 or 10, to establish a point number.

From operation 924, the method proceeds to operation 926, which determines if the roll outcome number is one of any of the numbers 2, 3, 11 or 12.

If, in operation 926, it is determined that the roll outcome number is one of any of the numbers 2, 3, 11 or 12, the method proceeds to operation 924, described above.

If, in operation 926, it is determined that the roll outcome number is not any of the numbers 2, 3, 11, 12, the method proceeds to operation 928, which determines if the roll outcome number is one of any of the numbers 4, 5, 6, 8, 9 or 10.

If, in operation 928, it is determined that the roll outcome number is any of the numbers 4, 5, 6, 8, 9 or 10, the method proceeds to operation 930, wherein a player loses a bet, the original wager is removed from play by the game facilitator and a bet is completed.

From operation 930, the method proceeds to 932, wherein the method ends and the current round continues normally. If a new SOSI bet is to be initialized, the method would begin at operation 902, described above.

If, in operation 928, it is determined that the roll outcome number is not any of the numbers 4, 5, 6, 8, 9 or 10, therefore the roll outcome number is a 7, the method proceeds to operation 934, which determines if the specific combination of the roll outcome number matches the SOX combination.

If, in operation 934, it is determined that the specific combination of the roll outcome number doesn't match the SOX combination, the method proceeds to operation 924, described above.

If, in operation 934, it is determined that the specific combination of the roll outcome number matches the SOX combination, the method proceeds to operation 936, which determines if the wager location is on the end line (in the final position) in the SOX wager box area.

If, in operation 936, it is determined that bet wager location is in the final position, the method proceeds to operation 938, wherein a player wins a bet, a payout is made per a predetermined payout schedule, the original wager is removed from play by the game facilitator and a bet is completed.

From operation 938, the method proceeds to operation 940, wherein the method ends and the current round continues normally. If a new SOSI bet is to be initialized the method would begin at operation 902, described above.

If, in operation 936, it is determined that the bet wager location is not in the final position, the method proceeds to operation 942, wherein a player can receive a payout (or not) at the player's option.

If, in operation 942, it is determined that that the player wants to receive a payout, the method proceeds to operation 938, described above.

If, in operation 942, it is determined that that the player doesn't want to receive a payout, the method proceeds to operation 944, wherein a wager is relocated to the next line position in the SOX wager box area.

From operation 944, the method proceeds to operation 924, described above.

Figure 10:
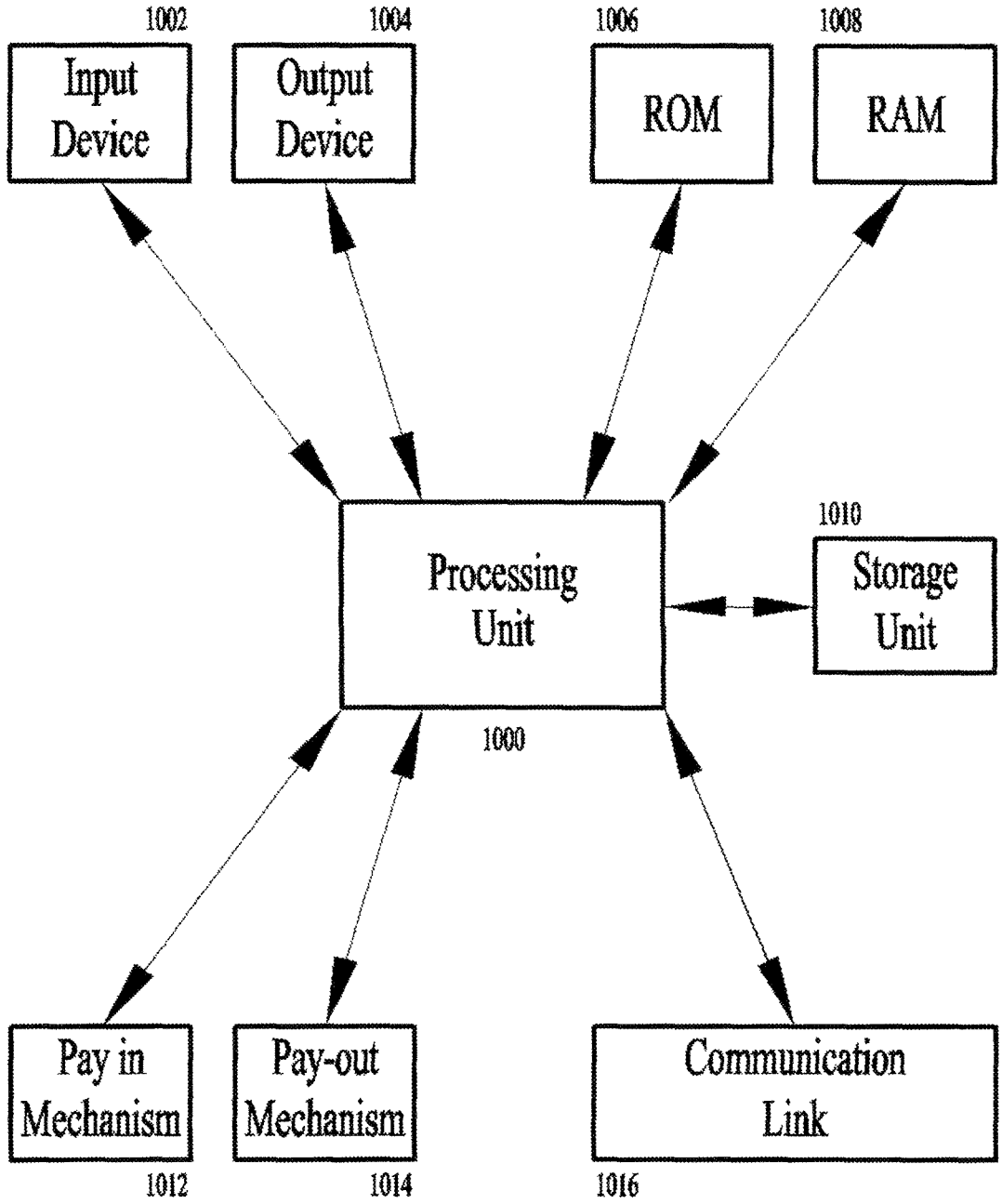
FIG. 10 is a block diagram illustrating one example of hardware that can be used to implement the present invention, according to an embodiment of the present invention.

FIG. 10 is a block diagram illustrating one example of hardware that can be used to implement the present invention, according to an embodiment of the present invention. Typically, an electronic gaming device (EGD) is used to implement the present invention.

A processing unit 1000 is connected to an input device(s) 1002 such as a touch sensitive display, buttons, keyboard, mouse, etc. The processing unit 1000 is also connected to an output device(s) 1004 such as a video display, audio output devices, etc.

The processing unit 1000 is also connected to a ROM 1006, RAM 1008, and a storage unit 1010 such as a hard drive, CD-ROM, etc. The processing unit 1000 is also connected to a financial apparatus including a pay in mechanism 1012, and a pay-out mechanism 1014, which can accept payments and handle all facets of financial transactions. The processing unit 1000 is also connected to a communications link 1016 which connects the gaming device to a casino network or other communications network.

Betting Scenarios and Payout Schedule Tables

The following betting scenarios can be used to construct various embodiments of the invention, either as configured in the referenced drawings or as any other combination of bets that contain one or more of the following betting scenarios, none of which currently exist in the game of casino craps. It should be noted that the "recommended payouts" for each betting scenario are listed as a guideline and are not intended to define or limit the betting scenarios.

TABLE 3a

Payout Schedule
Point-Stay Bet & Seven-Stay Bet
Wager Opportunities by Phase
Rules of Resolutions, Recommended Payout Ratios

| Bet by Stage | Phase | Winning Outcome | Losing outcome(s) | Unresolved outcome(s) | Recommended Payout Ratio |
|---|---|---|---|---|---|
| Point-Stay Bet 4 | Point | Point #-4 (a) | 7-out | 2, 3, 5, 6, 8, 9, 10, 11 or 12 | No Payout (1 for 1) |
| Point-Stay Bet 4 | Come-out | Stay #-4 | 5, 6, 8, 9 or 10 | 2, 3, 7, 11 or 12 | 23 for 1 |
| Point-Stay Bet 5 | Point | Point #-5 (a) | 7-out | 2, 3, 4, 6, 8, 9, 10, 11 or 12 | No Payout (1 for 1) |
| Point-Stay Bet 5 | Come-out | Stay #-5 | 4, 6, 8, 9 or 10 | 2, 3, 7, 11 or 12 | 14 for 1 |
| Point-Stay Bet 6 | Point | Point #-6 (a) | 7-out | 2, 3, 4, 5, 8, 9, 10, 11 or 12 | No Payout (1 for 1) |
| Point-Stay Bet 6 | Come-out | Stay #-6 | 4, 5, 8, 9 or 10 | 2, 3, 7, 11 or 12 | 10 for 1 |
| Point-Stay Bet 8 | Point | Point #-8 (a) | 7-out | 2, 3, 4, 5, 6, 9, 10, 11 or 12 | No Payout (1 for 1) |
| Point-Stay Bet 8 | Come-out | Stay #-8 | 4, 5, 6, 9 or 10 | 2, 3, 7, 11 or 12 | 10 for 1 |
| Point-Stay Bet 9 | Point | Point #-9 (a) | 7-out | 2, 3, 4, 5, 6, 8, 10, 11 or 12 | No Payout (1 for 1) |
| Point-Stay Bet 9 | Come-out | Stay #-9 | 4, 5, 6, 8 or 10 | 2, 3, 7, 11 or 12 | 14 for 1 |
| Point-Stay Bet 10 | Point | Point #-10 (a) | 7-out | 2, 3, 4, 5, 6, 8, 9, 11 or 12 | No Payout (1 for 1) |
| Point-Stay Bet 10 | Come-out | Stay #-10 | 4, 5, 6, 8 or 9 | 2, 3, 7, 11 or 12 | 23 for 1 |
| Seven-Stay Bet 4 | Point | 7-out (a) | Point #-4 | 2, 3, 5, 6, 8, 9, 10, 11 or 12 | No Payout (1 for 1) |
| Seven-Stay Bet 4 | Come-out | Stay #-4 | 5, 6, 8, 9 or 10 | 2, 3, 7, 11 or 12 | 23 for 1 |
| Seven-Stay Bet 5 | Point | 7-out (a) | Point #-5 | 2, 3, 4, 6, 8, 9, 10, 11 or 12 | No Payout (1 for 1) |
| Seven-Stay Bet 5 | Come-out | Stay #-5 | 4, 6, 8, 9 or 10 | 2, 3, 7, 11 or 12 | 14 for 1 |
| Seven-Stay Bet 6 | Point | 7-out (a) | Point #-6 | 2, 3, 4, 5, 8, 9, 10, 11 or 12 | No Payout (1 for 1) |

TABLE 3a-continued

Payout Schedule
Point-Stay Bet & Seven-Stay Bet
Wager Opportunities by Phase
Rules of Resolutions, Recommended Payout Ratios

| Bet by Stage | Phase | Winning Outcome | Losing outcome(s) | Unresolved outcome(s) | Recommended Payout Ratio |
|---|---|---|---|---|---|
| Seven-Stay Bet 6 | Come-out | Stay #-6 | 4, 5, 8, 9 or 10 | 2, 3, 7, 11 or 12 | 10 for 1 |
| Seven-Stay Bet 8 | Point | 7-out (a) | Point #-8 | 2, 3, 4, 5, 6, 9, 10, 11 or 12 | No Payout (1 for 1) |
| Seven-Stay Bet 8 | Come-out | Stay #-8 | 4, 5, 6, 9 or 10 | 2, 3, 7, 11 or 12 | 10 for 1 |
| Seven-Stay Bet 9 | Point | 7-out (a) | Point #-9 | 2, 3, 4, 5, 6, 8, 10, 11 or 12 | No Payout (1 for 1) |
| Seven-Stay Bet 9 | Come-out | Stay #-9 | 4, 5, 6, 8 or 10 | 2, 3, 7, 11 or 12 | 14 for 1 |
| Seven-Stay Bet 10 | Point | 7-out (a) | Point #-10 | 2, 3, 4, 5, 6, 8, 9, 11 or 12 | No Payout (1 for 1) |
| Seven-Stay Bet 10 | Come-out | Stay #-10 | 4, 5, 6, 8 or 9 | 2, 3, 7, 11 or 12 | 23 for 1 |

TABLE 3b

Payout Schedule
SOSI Bet
Wager Opportunities by Phase
Rules of Resolutions, Recommended Payout Ratios

| Bet by Stage | Phase | Winning outcome(s) | Losing outcome(s) | Unresolved outcome(s) | Recommended Payout Ratio |
|---|---|---|---|---|---|
| SOSI Bet 4 Start | Point | 7-out (a) | Point #-4 | 2, 3, 5, 6, 8, 9, 10, 11, 12 | No Payout (1 for 1) |
| SOSI Bet 4 #1 | Come-out | 7 | 4, 5, 6, 8, 9 or 10 | 2, 3, 11 or 12 | 7 for 1 |
| SOSI Bet 4 #2 | Come-out | 7 | 4, 5, 6, 8, 9 or 10 | 2, 3, 11 or 12 | 35 for 1 |
| SOSI Bet 4 #3 | Come-out | 7 | 4, 5, 6, 8, 9 or 10 | 2, 3, 11 or 12 | 175 for 1 |
| SOSI Bet 4 End | Come-out | 7 | 4, 5, 6, 8, 9 or 10 | 2, 3, 11 or 12 | 875 for 1 |
| SOSI Bet 5 Start | Point | 7-out (a) | Point #-5 | 2, 3, 4, 6, 8, 9, 10, 11, 12 | No Payout (1 for 1) |
| SOSI Bet 5 #1 | Come-out | 7 | 4, 5, 6, 8, 9 or 10 | 2, 3, 11 or 12 | 8 for 1 |
| SOSI Bet 5 #2 | Come-out | 7 | 4, 5, 6, 8, 9 or 10 | 2, 3, 11 or 12 | 40 for 1 |
| SOSI Bet 5 #3 | Come-out | 7 | 4, 5, 6, 8, 9 or 10 | 2, 3, 11 or 12 | 200 for 1 |
| SOSI Bet 5 End | Come-out | 7 | 4, 5, 6, 8, 9 or 10 | 2, 3, 11 or 12 | 1,000 for 1 |
| SOSI Bet 6 Start | Point | 7-out (a) | Point #-6 | 2, 3, 4, 5, 8, 9, 10, 11, 12 | No Payout (1 for 1) |
| SOSI Bet 6 #1 | Come-out | 7 | 4, 5, 6, 8, 9 or 10 | 2, 3, 11 or 12 | 9 for 1 |
| SOSI Bet 6 #2 | Come-out | 7 | 4, S. 6, 8, 9 or 10 | 2, 3, 11 or 12 | 45 for 1 |
| SOSI Bet 6 #3 | Come-out | 7 | 4, 5, 6, 8, 9 or 10 | 2, 3, 11 or 12 | 225 for 1 |
| SOSI Bet 6 End | Come-out | 7 | 4, 5, 6, 8, 9 or 10 | 2, 3, 11 or 12 | 1,125 for 1 |
| SOSI Bet 8 Start | Point | 7-out (a) | Point #-8 | 2, 3, 4, 5, 6, 9, 10, 11, 12 | No Payout (1 for 1) |
| SOSI Bet 8 #1 | Come-out | 7 | 4, 5, 6, 8, 9 or 10 | 2, 3, 11 or 12 | 9 for 1 |
| SOSI Bet 8 #2 | Come-out | 7 | 4, 5, 6, 8, 9 or 10 | 2, 3, 11 or 12 | 45 for 1 |
| SOSI Bet 8 #3 | Come-out | 7 | 4, 5, 6, 8, 9 or 10 | 2, 3, 11 or 12 | 225 for 1 |
| SOSI Bet End | Come-out | 7 | 4, 5, 6, 8, 9 or 10 | 2, 3, 11 or 12 | 1,125 for 1 |
| SOSI Bet 9 Start | Point | 7-out (a) | Point #-9 | 2, 3, 4, 5, 6, 8, 10, 11, 12 | No Payout (1 for 1) |
| SOSI Bet 9 #1 | Come-out | 7 | 4, 5, 6, 8, 9 or 10 | 2, 3, 11 or 12 | 8 for 1 |
| SOSI Bet 9 #2 | Come-out | 7 | 4, 5, 6, 8, 9 or 10 | 2, 3, 11 or 2 | 40 for 1 |
| SOSI Bet 9 #3 | Come-out | 7 | 4, 5, 6, 8, 9 or 10 | 2, 3, 11 or 12 | 200 for 1 |
| SOSI Bet 9 End | Come-out | 7 | 4, 5, 6: 8, 9 or 10 | 2, 3, 11 or 12 | 1,000 for 1 |
| SOSI Bet 10 Start | Point | 7-out (a) | Point #-10 | 2, 3, 4, 5, 6, 8, 9, 11, 12 | No Payout (1 for 1) |
| SOSI Bet 10 #1 | Come-out | 7 | 4, 5, 6, 8, 9 or 10 | 2, 3, 11 or 12 | 7 for 1 |
| SOSI Bet 10 #2 | Come-out | 7 | 4, 5, 6, 8, 9 or 10 | 2, 3, 11 or 12 | 35 for 1 |
| SOSI Bet 10 #3 | Come-out | 7 | 4, 5, 6, 8, 9 or 10 | 2, 3, 11 or 12 | 175 for 1 |
| SOSI Bet 10 End | Come-out | 7 | 4, 5, 6, 8, 9 or 10 | 2, 3, 11 or 12 | 875 for 1 |

TABLE 3c

Payout Schedule
SOX Bet
Wager Opportunities by Phase
Rules of Resolutions, Recommended Payout Ratios

| Bet by Stage | Phase | Winning outcome(s) | Losing outcome(s) | Unresolved outcome(s) | Recommended Payout Ratio |
|---|---|---|---|---|---|
| SOX Bet 4 Start | Point | 7-out (a) | Point #-4 | 2, 3, 5, 6, 8, 9, 10, 11, 12 | No Payout (1 for 1) |
| SOX Bet 4 #1 | Come-out | 7 | 4, 5, 6, 8, 9 or 10 | 2, 3, 11 or 12 | 35 for 1 |
| SOX Bet A End | Come-out | 7 | 4, 5, 6, 8, 9 or 10 | 2, 3, 11 or 12 | 875 for 1 |
| SOX Bet 5 Start | Point | 7-out (a) | Point #-5 | 2, 3, 4, 6, 8, 9, 10, 11, 12 | No Payout |
| SOX Bet 5 #1 | Come-out | 7 | 4, 5, 6, 8, 9 or 10 | 2, 3, 11 or 12 | 40 for 1 |
| SOX Bet 5 End | Come-out | 7 | 4, 5, 6, 8, 9 or 10 | 2, 3, 11 or 12 | 1,000 for 1 |
| SOX Bet 6 Start | Point | 7-out (a) | Point #-6 | 2, 3, 4, 5, 8, 9, 10, 11, 12 | No Payout (1 for 1) |
| SOX Bet 6 #1 | Come-out | 7 | 4, 5, 6, 8, 9 or 10 | 2, 3, 11 or 12 | 45 for 1 |
| SOX Bet 6 End | Come-out | 7 | 4, 5, 6, 8, 9 or 10 | 2, 3, 11 or 12 | 1,125 for 1 |
| SOX Bet 8 Start | Point | 7-out (a) | Point #-8 | 2, 3, 4, 5, 6, 9, 10, 11, 12 | No Payout (1 for 1) |
| SOX Bet 8 #1 | Come-out | 7 | 4, 5, 6, 8, 9 or 10 | 2, 3, 11 or 12 | 45 for 1 |
| SOX Bet 8 End | Come-out | 7 | 4, 5, 6, 8, 9 or 10 | 2, 3, 11 or 12 | 1,125 for 1 |
| SOX Bet 9 start | Point | 7-out (a) | Point #-9 | 2, 3, 4, 5, 6, 8, 10, 11, 12 | No Payout (1 for 1) |
| SOX Bet 9 #1 | Come-out | 7 | 4, 5, 6, 8, 9 or 10 | 2, 3, 11 or 12 | 40 for 1 |
| SOX Bet 9 End | Come-out | 7 | 4, 5, 6, 8, 9 or 10 | 2, 3, 11 or 12 | 1,000 for 1 |
| SOX Bet 10 Start | Point | 7-out (a) | Point #-10 | 2, 3, 4, 5, 6, 8, 9, 11, 12 | No Payout (1 for 1) |
| SOX Bet 10 #1 | Come-out | 7 | 4, 5, 6, 8, 9 or 10 | 2, 3, 11 or 12 | 35 for 1 |
| SOX Bet 10 End | Come-out | 7 | 4, 5, 6, 8, 9 or 10 | 2, 3, 11 or 12 | 875 for 1 |

Table 3a, 3b and 3c notes:

(a) When a roll of seven-out occurs, a bet is considered unresolved, the wager stays in play, and the bet remains active with no payout. Alternatively, a bet could also be considered a win with a payout of 1 for 1, wherein a player can receive a payout and end the bet (or not, at the players option) and the wager stays in play and the bet remains active.

TABLE 4a

Bet Guidelines Casino Craps - Prior Art Line & Field Bets By Phase

| | Pass | Pass Odds | Don't Pass | Don't Pass Odds | Come | Come Odds | Don't Come | Don't Come Odds | Field |
|---|---|---|---|---|---|---|---|---|---|
| COME-OUT PHASE | | | | | | | | | |
| Initiate in This Phase | Yes | No | Yes | No | No | No | No | No | Yes |
| Automatically Active | Yes | N/A | Yes | N/A | N/A | N/A | N/A | N/A | Yes |
| Turn On | N/A | N/A | N/A | N/A | N/A | N/A | N/A | N/A | N/A |
| Turn Off | N/A | N/A | N/A | N/A | N/A | N/A | N/A | N/A | N/A |
| Increase | No | N/A | No | N/A | N/A | N/A | N/A | N/A | N/A |
| Decrease | No | N/A | Yes | N/A | N/A | N/A | N/A | N/A | N/A |
| Remove | No | N/A | Yes | N/A | N/A | N/A | N/A | N/A | N/A |
| Stays Active Into Point Phase | Yes | N/A | Yes | N/A | N/A | N/A | N/A | N/A | N/A |
| POINT PHASE | | | | | | | | | |
| Initiate in This Phase | Yes | Yes | No | Yes | Yes | Yes | Yes | Yes | Yes |
| Automatically Active | Yes | Yes | Yes | Yes | Yes | Yes | Yes | Yes | Yes |
| Turn On | N/A | N/A | N/A | N/A | N/A | | Yes | | N/A |
| Turn Off | No | N/A | No | N/A | No | | No | | N/A |
| Increase | Yes | Yes | No | Yes | Yes | Yes | No | Yes | N/A |
| Decrease | No | Yes | Yes | Yes | No | Yes | Yes | Yes | N/A |
| Remove | No | Yes | Yes | Yes | No | Yes | Yes | Yes | N/A |
| Resolution on Making Point | Win | Win | Lose | Lose | Win | Win | Loss | Loss | Win or Loss |
| Resolution on Seven-out | Loss | Lose | Win | Win | Loss | Loss | Win | Win | Loss |

TABLE 4b

| Bet Guidelines Casino Craps - Prior Art Single Roll & Multiple Roll Bets By Phase | | | | | | | | | | | |
|---|---|---|---|---|---|---|---|---|---|---|---|
| | C & E | Any Craps | 2 | 3 | 11 | 12 | Horn | Any 7 | World | Place | Hardways |
| COME-OUT PHASE | | | | | | | | | | | |
| Initiate in This Phase | Yes | Yes | Yes | Yes | Yes | Yes | Yes | Yes | Yes | Yes | Yes |
| Automatically Active | Yes | Yes | Yes | Yes | Yes | Yes | YES | Yes | Yes | Yes | No |
| Turn On | N/A | N/A | N/A | N/A | N/A | N/A | N/A | N/A | N/A | N/A | Yes |
| Turn Off | N/A | N/A | N/A | N/A | N/A | N/A | N/A | N/A | N/A | N/A | Yes |
| Increase | N/A | N/A | N/A | N/A | N/A | N/A | N/A | N/A | N/A | N/A | Yes |
| Decrease | N/A | N/A | N/A | N/A | N/A | N/A | N/A | N/A | N/A | N/A | Yes |
| Remove | N/A | N/A | N/A | N/A | N/A | N/A | N/A | N/A | N/A | N/A | Yes |
| Stays Active into Point Phase | N/A | N/A | N/A | N/A | N/A | N/A | N/A | N/A | N/A | N/A | Yes |
| POINT PHASE | | | | | | | | | | | |
| Initiate in This Phase | Yes | Yes | Yes | Yes | Yes | Yes | Yes | Yes | Yes | Yes | Yes |
| Automatically Active | Yes | Yes | Yes | Yes | Yes | Yes | Yes | Yes | Yes | Yes | Yes |
| Turn On | N/A | N/A | N/A | N/A | N/A | N/A | N/A | N/A | N/A | N/A | Yes |
| Turn Ott | N/A | N/A | N/A | N/A | N/A | N/A | N/A | N/A | N/A | N/A | Yes |
| Increase | N/A | N/A | N/A | N/A | N/A | N/A | N/A | N/A | N/A | N/A | Yes |
| Decrease | N/A | N/A | N/A | N/A | N/A | N/A | N/A | N/A | N/A | N/A | Yes |
| Remove | N/A | N/A | N/A | N/A | N/A | N/A | N/A | N/A | N/A | N/A | Yes |
| Resolution on Making Point | Loss | Loss | Loss | Loss | Loss | Loss | Loss | Loss | Loss | Win | Win or Loss |
| Resolution on Seven-out | Loss | Loss | Loss | Loss | Loss | Loss | Loss | Win | Win | Loss | Loss |

TABLE 4c

| Bet Guidelines Casino Craps Side Bets - Prior Art & Present Invention By Phase | | | | | | | | | | |
|---|---|---|---|---|---|---|---|---|---|---|
| | FIRE Bet | Small Tall | All | 7 Point 7 | Sharp Shooter | Replay | Point STAY | Seven STAY | SOSI | SOX |
| COME OUT PHASE | | | | | | | | | | |
| Initiate in This Phase | Yes | Yes | Yes | Yes | Yes | Yes | No | No | No | No |
| Automatically Active | Yes | Yes | Yes | Yes | Yes | Yes | N/A (*) | N/A | N/A | N/A |
| Turn On | N/A | N/A | N/A | N/A | N/A | N/A | N/A | N/A | N/A | N/A |
| Turn Off | N/A | N/A | N/A | N/A | N/A | N/A | N/A | N/A | N/A | N/A |
| Increase | N/A | N/A | N/A | N/A | N/A | N/A | N/A | N/A | N/A | N/A |
| Decrease | N/A | N/A | N/A | N/A | N/A | N/A | N/A | N/A | N/A | N/A |
| Remove | N/A | N/A | N/A | N/A | N/A | N/A | N/A | N/A | N/A | N/A |
| Stays Active Into Point Phase | Yes | Yes | Yes | Yes | Yes | Yes | N/A | N/A | N/A | N/A |
| POINT PHASE | | | | | | | | | | |
| Initiate in This Phase | No | No | No | No | No | No | Yes | Yes | Yes | Yes |
| Automatically Active | Yes | Yes | Yes | Yes | Yes | Yes | Yes | Yes | Yes | Yes |
| Turn On | N/A | N/A | N/A | N/A | N/A | N/A | N/A | N/A | N/A | N/A |
| Turn Off | N/A | N/A | N/A | N/A | N/A | N/A | N/A | N/A | N/A | N/A |
| Increase | N/A | N/A | N/A | N/A | N/A | N/A | Yes | Yes | Yes | Yes |
| Decrease | N/A | N/A | N/A | N/A | N/A | N/A | N/A | N/A | N/A | N/A |
| Remove | N/A | N/A | N/A | N/A | N/A | N/A | N/A | N/A | N/A | N/A |
| Resolution on Making Point | Win | Win | Win | Win | Win | Win | Win | Loss | Loss | Loss |
| Resolution on Seven-out | Loss | Loss | Loss | Loss | Loss | Loss | Loss | Win Unrsl | Win Unrsl | Win Unrsl |

The intent of the present invention is to offer to the game of casino craps additional side bets which require very little in terms of changes to the existing layout, that are simple to understand, allow minimal wagered amounts to provide for possible large payouts, create excitement by offering previously unavailable bets yet maintaining a house edge that provide for a long term profit to the game facilitator.

The methods herein can be played on electronic form such as an Internet casino, electronic gaming machine, electronic gaming device, home computer, electro-mechanical machine, etc. The methods herein can also be played in physical form using dice, tables, and chips which can be directly redeemable for cash.

It is also noted that any and/or all of the above embodiments, configurations, variations of the present invention described above can be mixed and matched and used in any combination with one another. Any claim herein can be combined with any others (unless the results are nonsensical).

Further, the operations described herein can be performed in any sensible order. Any operations not required for proper operation can be optional. Further, all methods described herein can also be stored on a computer readable storage to control a computer.

Moreover, any description of a component or embodiment herein also includes hardware, software, and configurations which already exist in the prior art and may be necessary to the operation of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of wagering to include a side bet during a game of casino craps, the method comprising:

executing instructions to perform the following operations on an electronic gaming system consisting of at least one processing unit connected to at least one input device, at least one output display device, and at least one memory device;

providing an image of two identical standard six-sided dice;

providing an image of a gaming table;

providing wager box areas on the image of the gaming table for standard craps bets and bets of the present invention;

conducting a casino craps game allowing for at least one additional side bet further comprising;

a) offering to a player the opportunity to roll the dice;

b) considering a player to be the shooter when he or she rolls the dice;

c) allowing the simulation of a roll of the dice one or more times during a come-out phase until a point number is established;

d) receiving a wager from a player for at least one bet of a first set of bets;

e) allowing the simulation of a roll of the dice during a point phase to produce a roll outcome number;

f) determining if the roll outcome number is at least one of a predetermined first group of numbers, and if not, offering a player the option to increase a wager on any existing bet received in operation d, or initiate a wager for an additional bet of a first set of bets (if not previously initiated) and performing operation e;

g) determining if a bet is at least one of a predetermined second set of bets, and if so, performing operation m;

h) determining if the roll outcome number is the point number, and if so, performing operation l;

i) considering the previously established point number to be the stay number;

j) considering a bet to be unresolved per a predetermined payout schedule for a winning outcome as defined by the rules of resolution and the bet remaining active and in play;

k) offering to a next player, in sequential order, the opportunity to be a shooter for a new round of a game and performing operation q;

l) determining if a bet is a losing bet by the rules of resolution, and if so, removing the wager and performing operation t;

m) determining if the roll outcome number is the point number, and if so, performing operation o;

n) determining if a bet is defined as a losing bet by the rules of resolution, and if so, removing the wager and performing operation t;

o) considering the made point number to be the stay number;

p) considering a bet to be unresolved per a predetermined payout schedule for a winning outcome as defined by the rules of resolution and the bet remaining active and in play, q) allowing the simulation of a roll of the dice one or more times during a come-out phase until a point number is established;

r) determining if the point number matches the stay number, and if so, providing a payout per a predetermined payout schedule and performing operation t;

s) removing the wager of a bet defined as a losing bet by the rules of resolution; and t) completing a bet, ending the method and continuing the round per standard rules of play for a round of casino craps.

2. The method as recited in claim 1, wherein the first set of bets includes a Point-Stay bet, and a Seven-Stay bet.

3. The method as recited in claim 1, wherein the second set of bets includes a Point-Stay bet.

4. The method as recited in claim 1, wherein the first group of numbers consists of the number 7 and the point number.

5. An apparatus to play a side bet during the game of casino craps, the apparatus comprising:

an electronic gaming system consisting of at least one processing unit connected to at least one input device, at least one output display device, and at least one memory device, at least one processing unit configured to:

provide an image of two identical standard six-sided dice;

provide an image of a gaming table;

providing wager box areas on the image of the gaming table for standard craps bets and bets of the present invention;

conduct a casino craps game allowing for at least one additional side bet further comprising:

a) offer to a player the opportunity to roll the dice;

b) consider a player to be the shooter when he or she rolls the dice;

c) allow the simulation of a roll of the dice one or more times during a come-out phase until a point number is established;

d) receive a wager from a player for at least one bet of a first set of bets;

e) allow the simulation of a roll of the dice during a point phase to produce a roll outcome number;

f) determine if the roll outcome number is at least one of a predetermined first group of numbers, and if not, offer a player the option to increase a wager on any existing bet received in operation d, or initiate a wager for an additional bet of a first set of bets (if not previously initiated) and perform operation e;

g) determine if a bet is at least one of a predetermined second set of bets, and if so, perform operation m;

h) determine if the roll outcome number is the point number, and if so, perform operation l;

i) consider the previously established point number to be the stay number;

j) consider a bet to be unresolved per a predetermined payout schedule for a winning outcome as defined by the rules of resolution and the bet remains active and in play;

k) offer to a next player, in sequential order, the opportunity to be a shooter for a new round of a game and perform operation q;

l) determine if a bet is a losing bet by the rules of resolution, and if so, remove the wager and perform operation t;

m) determine if the roll outcome number is the point number, and if so, perform operation o;

n) determine if a bet is defined as a losing bet by the rules of resolution, and if so, remove the wager and perform operation t;

o) consider the made point number to be the stay number;

p) consider a bet to be unresolved per a predetermined payout schedule for a winning outcome as defined by the rules of resolution and the bet remains active and in play;

q) allow the simulation of a roll of the dice one or more times during a come-out phase until a point number is established;

r) determine if the point number matches the stay number, and if so, provide a payout per a predetermined payout schedule and perform operation t;

s) remove the wager of a bet defined as a losing bet by the rules of resolution; and t) complete a bet, end the method and continuing the round per standard rules of play for a round of casino craps.

6. The apparatus as recited in claim 5, wherein the first set of bets includes a Point-Stay bet, and a Seven-Stay bet.

7. The apparatus as recited in claim 5, wherein the second set of bets includes a Point-Stay bet.

8. The apparatus as recited in claim 5, wherein the first group of numbers consists of the number 7 and the point number.

* * * * *